US008594538B2

(12) United States Patent
Mihara et al.

(10) Patent No.: US 8,594,538 B2
(45) Date of Patent: Nov. 26, 2013

(54) DEVELOPING DEVICE AND IMAGE FORMING APPARATUS

(75) Inventors: Koichi Mihara, Osaka (JP); Takafumi Nagai, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 190 days.

(21) Appl. No.: 13/354,700

(22) Filed: Jan. 20, 2012

(65) Prior Publication Data

US 2012/0189353 A1 Jul. 26, 2012

(30) Foreign Application Priority Data

Jan. 20, 2011 (JP) ..... P2011-10278

(51) Int. Cl.
*G03G 15/08* (2006.01)

(52) U.S. Cl.
USPC ..... 399/256; 399/254; 399/366

(58) Field of Classification Search
USPC ..... 399/254, 256, 366
See application file for complete search history.

(56) References Cited

U.S. PATENT DOCUMENTS

| | | | | |
|---|---|---|---|---|
| 7,356,288 | B2 | 4/2008 | Iwata et al. | |
| 2004/0179865 | A1 | 9/2004 | Nishiyama | |
| 2012/0051794 | A1 * | 3/2012 | Hayashi et al. | 399/254 |

FOREIGN PATENT DOCUMENTS

| | | |
|---|---|---|
| JP | 2004-272017 | 9/2004 |
| JP | 2006-162810 | 6/2006 |
| JP | 2006-163292 | 6/2006 |

* cited by examiner

*Primary Examiner* — Walter L Lindsay, Jr.
*Assistant Examiner* — Roy Y Yi
(74) *Attorney, Agent, or Firm* — Nixon & Vanderhye, P.C.

(57) ABSTRACT

A developing device includes a developer tank and a developing roller. An internal space of the developer tank is divided into a first conveying path, a second conveying path, a first communication path, and a second communication path by a partition wall. In the first conveying path, there is disposed a first developer conveying section that conveys the developer within the developer tank in a conveying direction X. In the second conveying path, there is disposed a second developer conveying section that conveys the developer within the developer tank in a conveying direction Y. The first developer conveying section includes an inner spiral blade, an outer spiral blade, an upstream spiral blade, a rotation tube, a delivery portion, support members, and a first gear. The rotation tube has an admission port portion and a discharge port portion.

5 Claims, 13 Drawing Sheets

DEVELOPING DEVICE AND IMAGE FORMING APPARATUS

CROSS-REFERENCE TO RELATED APPLICATION

This application claims priority to Japanese Patent Application No. 2011-10278, which was filed on Jan. 20, 2011, the contents of which are incorporated herein by reference in its entirety.

BACKGROUND OF THE TECHNOLOGY

1. Field of the Technology The present technology relates to a developing device and an image forming apparatus.

2. Description of the Related Art

Copiers, printers, facsimiles, or the like include an image forming apparatus that forms an image by electrophotography. The electrophotographic image forming apparatus forms an electrostatic latent image on a surface of an image bearing member (photoreceptor) using a charging device and an exposure device, develops the electrostatic latent image by supplying developer using a developing device, transfers the developer image on the photoreceptor to a recording medium such as recording paper using a transfer section, and fixes the developer image onto the recording paper using a fixing device and thereby forms an image.

The developer supplied to the photoreceptor by the developing device is contained in a developer tank provided in the developing device. The developer contained in the developer tank is conveyed to a developing roller provided in the developing device. The developing roller rotates while bearing the developer on a surface thereof, and supplies the developer to the photoreceptor. The developer is charged while being conveyed to the developing roller, and the charged developer is moved from the developing roller to the photoreceptor by electrostatic force between the surface of the photoreceptor and the electrostatic latent image. In this manner, the developing device develops the electrostatic latent image on the surface of the photoreceptor, and forms the developer image.

In recent years, accompanying the increase in speed and miniaturization of the image forming apparatus, a developing device capable of quickly and sufficiently performing the charging of the developer has been demanded. For example, Japanese Unexamined Patent Publication JP-A 2004-272017 discloses a circulation-type developing device including a developer conveying section that has a first conveying path, a second conveying path, a first communication path, and a second communication path which are formed by a partition wall provided inside a developer tank, and that conveys the developer in the first conveying path and the second conveying path in directions opposite to each other. The developer conveying section disclosed in JP-A 2004-272017 has a configuration where, to an auger screw type rotation shaft member having a rotation shaft member and a spiral blade spirally wound around the rotation shaft member, a flat plate-like member (fin) parallel with an axial line of the rotation shaft member is provided.

In the developer conveying section described in JP-A 2004-272017, a developer is conveyed in an axial direction of the rotation shaft member by the spiral blade, and the developer is also moved in a direction circumferentially of the rotation shaft member by the main surface of the fin while being electrically charged by friction. However, the negative aspect of the developer conveying section is that the developer is compressed when sandwiched between the spiral blade and the side surface of the fin, and the developer in a compressed state cannot be frictionally charged to a sufficient degree. If such an insufficiently charged developer is used, the image forming apparatus will fail to produce high-quality images.

SUMMARY OF THE TECHNOLOGY

The technology has been devised to solve the problem as mentioned supra, and accordingly its object is to provide a developing device capable of charging a developer sufficiently and an image forming apparatus.

The technology provides a developing device for developing an electrostatic latent image formed on an image bearing member by supplying a stored developer to the image bearing member, including:

a developer tank that stores a developer;

a partition wall that divides an internal space of the developer tank into:

a first conveying path extending along a longitudinal direction of the partition wall, a second conveying path extending along the first conveying path so that the partition wall is between the first conveying path and the second conveying path, and being closer to the image bearing member, a first communication path for providing communication between the first conveying path and the second conveying path at a side of one end of the partition wall in the longitudinal direction, and a second communication path for providing communication between the first conveying path and the second conveying path at a side of the other end of the partition wall in the longitudinal direction;

a first developer conveying section that is disposed in the first conveying path and conveys a developer in the developer tank from the side of the other end to the side of the one end of the partition wall in the longitudinal direction, the first developer conveying section including:

an inner spiral blade having a shape that is spirally wound on a side surface of an imaginary circular column, the inner spiral blade being rotated around an axial line of the imaginary circular column for conveying a developer from the side of the other end to the side of the one end of the partition wall in the longitudinal direction, a rotation tube configured to surround an outer circumference of the inner spiral blade and rotate with the inner spiral blade, and comprising an admission port portion in which a hole for admitting a developer into the rotation tube is formed and a discharge port portion in which a hole for discharging a developer from the inside of the rotation tube is formed, the admission port portion being at the side of the other end of the partition wall in the longitudinal direction and the discharge port portion being at the side of the one end of the partition wall in the longitudinal direction, and a delivery portion fixed to a part of an outer periphery of the rotation tube, the part being at the side of the one end of the partition wall in the longitudinal direction, the delivery portion rotating with the rotation tube to deliver a developer existing outside the rotation tube to the first communication path, the discharge port portion being disposed between one end and the other end of the delivery portion in the longitudinal direction; and a second developer conveying section that is disposed in the second conveying path, and conveys a developer from the side of the one end to the side of the other end of the partition wall in the longitudinal direction.

A developer within the first conveying path flows, through the admission port portion of the rotation tube, into the rotation tube. Then, the developer is conveyed toward the side of the one end of the partition wall in the longitudinal direction by the inner spiral blade attached to the rotation tube thereinside, and flows out of the rotation tube through the discharge port portion of the rotation tube. At this time, the rotation tube is in a state of rotating with the inner spiral blade. With the rotation, friction is produced between the developer which is being conveyed by the inner spiral blade and the inner peripheral wall of the rotation tube, whereupon the developer is electrically charged.

Moreover, the developer which has flowed out from the discharge port portion of the rotation tube is delivered to the first communication path by the delivery portion fixed to a part of the outer periphery of the rotation tube, the part being at the side of the one end of the partition wall in the longitudinal direction. Since the discharge port portion is disposed between the one end and the other end of the delivery portion in the longitudinal direction, it is possible to suppress that the developer is compressed when sandwiched between the inner spiral blade and the delivery portion, with the result that the developer can be conveyed smoothly while being kept in a fully charged state.

Hence, the developing device pursuant to the technology is capable of conveying a developer in a fully charged state in the first conveying path, and is thus conducive to the formation of high-quality images.

Moreover, it is preferable that a direction of rotation of the inner spiral blade is determined so that a part of the delivery portion located toward the first communication path moves vertically upward while the inner spiral blade rotates.

A direction of rotation of the inner spiral blade is determined so that a part of the delivery portion located toward the first communication path moves vertically upward while the inner spiral blade rotates. Thus, in the developing device pursuant to the technology, the developer which has flowed out through the discharge port portion can be directed swiftly to the first communication path, wherefore the stress applied to the developer can be suppressed.

Moreover, it is preferable that the developer tank includes a first communication path bottom part opposed to the first communication path, the first communication path bottom part being configured so as to extend along a vertical upwards direction with increasing distance from the first conveying path and the second conveying path.

The developer tank includes a first communication path bottom part opposed to the first communication path, the first communication path bottom part being configured so as to extend along the vertical upwards direction with increasing distance from the first conveying path and the second conveying path. Thus, in the developing device pursuant to the technology, the developer is restrained from moving from the second conveying path to the first communication path, and from there to the first conveying path. This makes smooth conveyance of the developer possible.

Moreover, it is preferable that a vertically upper part of the first communication path bottom part is situated vertically below a level of the axial line of the imaginary circular column.

Moreover, a vertically upper part of the first communication path bottom part is situated vertically below a level of the axial line of the imaginary circular column surrounded by the inner spiral blade. In this way, the developer sliding down the delivery portion is allowed to move, through the first communication path, to the second conveying path. Thus, the developing device of the technology is capable of conveying the developer even more smoothly.

Moreover, it is preferable that the first developer conveying section further includes an outer spiral blade which is fixed to a part of the outer periphery of the rotation tube located toward the side of the other end of the partition wall in the longitudinal direction, and rotates with the rotation tube to guide a developer existing outside the rotation tube into the admission port portion, and the developing device further includes a supply port portion situated vertically above the outer spiral blade, for supplying a developer into the developer tank.

The first developer conveying section includes the outer spiral blade, and the supply port portion for supplying a developer is disposed vertically above the outer spiral blade. Therefore, a fresh developer which has been supplied through the supply port portion is firstly conveyed toward the side of the other end of the partition wall in the longitudinal direction by the outer spiral blade, and whereafter flows into the rotation tube through the admission port portion of the rotation tube. Then, the developer is conveyed toward the side of the one end of the partition wall in the longitudinal direction by the inner spiral blade. Thus, according to the developing device of the technology, it is possible to lengthen the distance that a fresh developer is conveyed without the necessity of upsizing of the developer tank, and thereby increase the chance of development of friction between the fresh developer and the inner wall of the developer tank, as well as the outer periphery of the rotation tube. As a result, the fresh developer can be electrically charged even more reliably.

Moreover, it is preferable that the outer spiral blade is positioned so as to face the second communication path.

The outer spiral blade is positioned so as to face the second communication path. Therefore, the developer which has been conveyed through the second communication path to the first conveying path and a fresh developer which has been supplied through the supply port portion are each conveyed toward the side of the other end of the partition wall in the longitudinal direction, and whereafter flow into the rotation tube. In this way, in the developing device of the technology, the existing developer stored in the developer tank and the fresh developer supplied through the supply port portion can be mixed thoroughly, wherefore insufficient developer charging can be suppressed.

Moreover, it is preferable that the developing device further includes an auxiliary tank having an internal space which communicates with a part of the first conveying path located toward the side of the other end of the partition wall in the longitudinal direction, and the rotation tube extends to the internal space of the auxiliary tank.

The developing device has the auxiliary tank, and the internal space of the auxiliary tank communicates with a part of the first conveying path located toward the side of the other end of the partition wall in the longitudinal direction. The rotation tube of the first developer conveying section extends into the auxiliary tank. Therefore, a fresh developer supplied through the supply port portion is conveyed into the auxiliary tank by the outer spiral blade, and then flows into the rotation tube through the admission port portion. Thus, according to the developing device of the technology, it is possible to lengthen the distance that the fresh developer is conveyed even further, and thereby increase the chance of development of friction between the fresh developer and the inner wall of the auxiliary tank, as well as the outer periphery of the rotation tube. As a result, the fresh developer can be electrically charged even more reliably.

Moreover, it is preferable that the outer spiral blade has a shape which has a constant internal diameter and an external diameter which becomes small continuously as it advances on the side of the other end of the partition wall in the longitudinal direction, and the auxiliary tank includes a first peripheral wall part which is made to conform to an outer circumference of the outer spiral blade, and is spaced at a predetermined distance away from the outer circumference of the outer spiral blade.

The outer spiral blade has a shape which has a constant internal diameter and an external diameter which becomes small continuously as it advances on the side of the other end of the partition wall in the longitudinal direction. The auxiliary tank includes the first peripheral wall part which is made to conform to an outer circumference of the outer spiral blade, and is spaced at a predetermined distance away from the outer circumference of the outer spiral blade. Thus, the distance between the rotation tube formed fixedly with the outer spiral blade and the vertically lower part of the first peripheral wall part becomes narrower gradually as it advances on the side of the other end of the partition wall in the longitudinal direction. Therefore, of the fresh developer supplied through the supply port portion, a part contacted by the vertically lower part of the first peripheral wall part is conveyed toward the side of the other end of the partition wall in the longitudinal direction by the outer spiral blade while being pushed vertically upwardly along the first peripheral wall part by the rotation tube. As a result, friction is produced between the developer which is being conveyed by the outer spiral blade and the first peripheral wall part, whereupon the developer is electrically charged. In this way, according to the developing device of the technology, the fresh developer which has been supplied through the supply port portion can be electrically charged even more reliably.

Moreover, it is preferable that the first developer conveying section includes an upstream spiral blade which guides the developer existing outside the rotation tube into the admission port portion, is continuous with a part of the inner spiral blade located toward the side of the other end of the partition wall in the longitudinal direction, and has a shape which has a constant internal diameter and an external diameter which becomes small continuously as it advances on the side of the other end of the partition wall in the longitudinal direction, and the auxiliary tank includes a second peripheral wall part which is made to conform to an outer circumference of the upstream spiral blade, and is spaced at a predetermined distance away from the outer circumference of the upstream spiral blade.

The first developer conveying section includes an upstream spiral blade which is continuous with that part of the inner spiral blade located toward the side of the other end of the partition wall in the longitudinal direction, and, has a shape which a constant internal diameter and an external diameter which becomes small continuously as it advances on the side of the other end of the partition wall in the longitudinal direction (expressed differently, the external diameter thereof increases continuously as it advances on the side of the one end of the partition wall in the longitudinal direction). The auxiliary tank includes a second peripheral wall part which is made to conform to the outer circumference of the upstream spiral blade, and is spaced at a predetermined distance away from the outer circumference of the upstream spiral blade. Therefore, the amount of developer to be conveyed toward the side of the one end of the partition wall in the longitudinal direction by the upstream spiral blade increases gradually as it advances on the side of the one end of the partition wall in the longitudinal direction. This makes it possible to reduce the rate of developer conveying effected by the upstream spiral blade as a whole while keeping the amount of developer to be conveyed in the vicinity of the admission port portion of the rotation tube at a high level. As a result, the developer can be guided adequately into the rotation tube more reliably.

Moreover, it is preferable that the first developer conveying section further includes columnar support members located at one end and the other end thereof in the longitudinal direction, respectively.

The first developer conveying section includes columnar support members located at the one end and the other end thereof in the longitudinal direction, respectively. Therefore, it is possible to drive the first developer conveying section via the support members, with the consequent simplification of a driving mechanism of the developing device.

Moreover, it is preferable that the developer tank includes:

a first conveying path-downstream region bottom part opposed to a part of the first conveying path located toward the side of the one end of the partition wall in the longitudinal direction; and a downstream barrier part which is adjacent to the first conveying path-downstream region bottom part at a location toward the side of the other end of the partition wall in the longitudinal direction beyond the first conveying path-downstream region bottom part, and extends along a vertical upwards direction so as to be situated vertically above a level of the first conveying path-downstream region bottom part.

The developer tank includes a downstream barrier part which is adjacent to a first conveying path-downstream region bottom part at a location toward the side of the other end of the partition wall in the longitudinal direction beyond the first conveying path-downstream region bottom part, and extends along a vertical upwards direction so as to be situated vertically above a level of the first conveying path-downstream region bottom part. Thus, in the developing device of the technology, it is possible to suppress entry of the developer into the space between the first developer conveying section and the inner wall of the developer tank from the side of the one end of the partition wall in the longitudinal direction.

Moreover, it is preferable that the developer tank includes:

a first conveying path-upstream region bottom part opposed to a part of the first conveying path located toward the side of the other end of the partition wall in the longitudinal direction; and an upstream barrier part which is adjacent to the first conveying path-upstream region bottom part at a location toward the side of the one end of the partition wall in the longitudinal direction beyond the first conveying path-upstream region bottom part, and extends along a vertical upwards direction so as to be situated vertically above a level of the first conveying path-upstream region bottom part.

The developer tank includes an upstream barrier part which is adjacent to a first conveying path-upstream region bottom part at a location toward the side of the one end of the partition wall in the longitudinal direction beyond the first conveying path-upstream region bottom part, and extends along the vertical upwards direction so as to be situated vertically above a level of the first conveying path-upstream region bottom part. Thus, in the developing device of the technology, it is possible to suppress entry of the developer into the space between the first developer conveying section and the inner wall of the developer tank from the side of the other end of the partition wall in the longitudinal direction.

The technology provides an electrophotographic image forming apparatus including the developing device mentioned above.

The image forming apparatus includes the developing device mentioned above. In this construction, an image is formed under a condition where a developer is fully charged by the developing device. Thus, the image forming apparatus of the technology is capable of forming high-quality images with stability.

BRIEF DESCRIPTION OF THE DRAWINGS

Other and further objects, features, and advantages of the technology will be more explicit from the following detailed description taken with reference to the drawings wherein.

DETAILED DESCRIPTION

Figure 1:
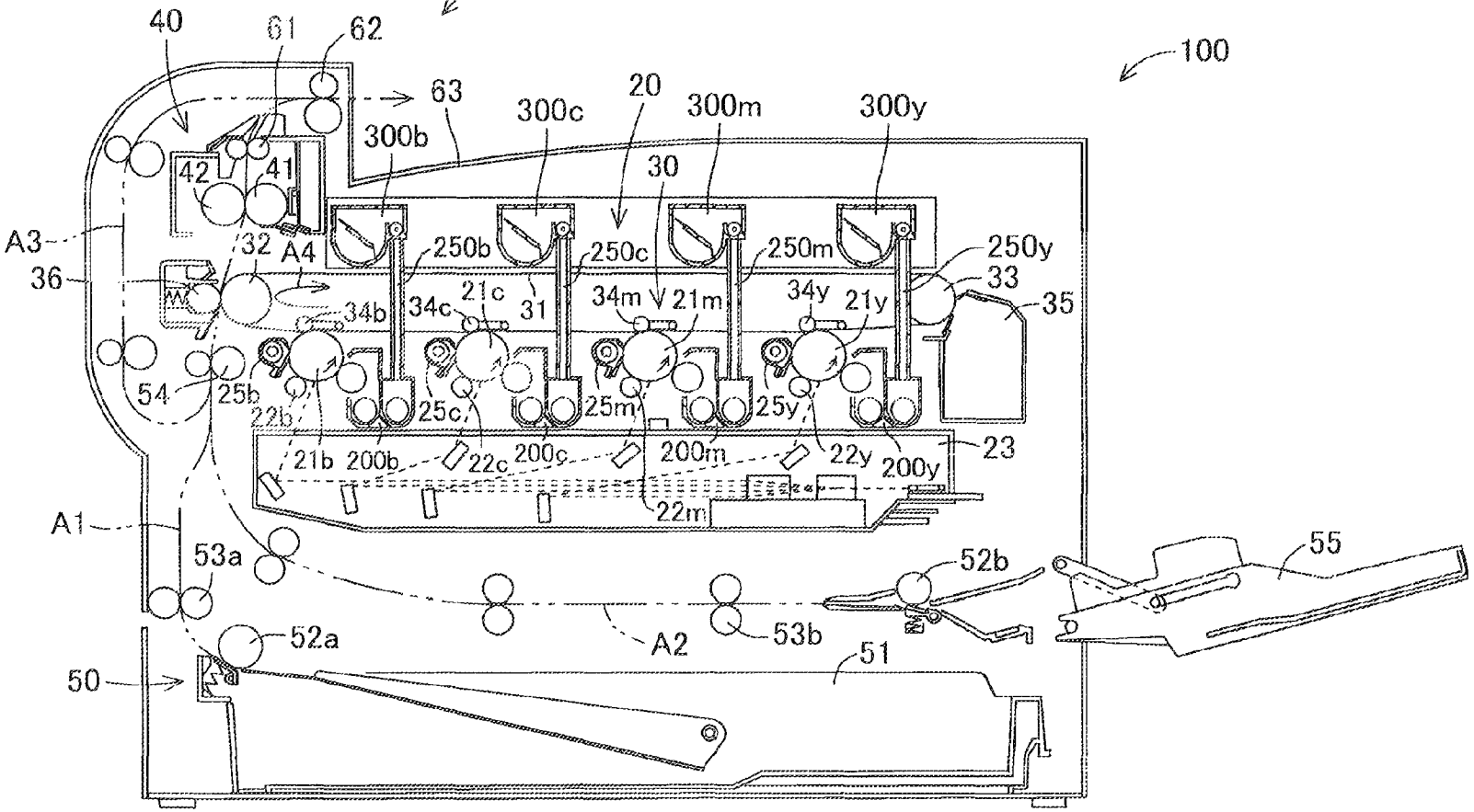
FIG. 1 is a schematic view illustrating a configuration of an image forming apparatus.

Now referring to the drawings, preferred embodiments are described below.

First, an image forming apparatus 100 including a developing device 200 according to an embodiment will be described. FIG. 1 is a schematic view illustrating a configuration of the image forming apparatus 100. The image forming apparatus 100 is a multi-functional peripheral having a copying function, a printing function, and a facsimile function, and forms a full color image or a monochrome image on a recording medium according to transferred image information.

The image forming apparatus 100 includes a toner image forming section 20, a transfer section 30, a fixing section 40, a recording medium feeding section 50, a discharging section 60, and a control unit section (not shown). The toner image forming section 20 includes photoreceptor drums 21*b*, 21*c*, 21*m*, and 21*y*, charging sections 22*b*, 22*c*, 22*m*, and 22*y*, an exposure unit 23, developing devices 200*b*, 200*c*, 200*m*, and 200*y*, cleaning units 25*b*, 25*c*, 25*m*, and 25*y*, toner cartridges 300*b*, 300*c*, 300*m*, and 300*y*, and toner supplying pipes 250*b*, 250*c*, 250*m*, and 250*y*. The transfer section 30 includes an intermediate transfer belt 31, a driving roller 32, a driven roller 33, intermediate transfer rollers 34*b*, 34*c*, 34*m*, and 34*y*, a transfer belt cleaning unit 35, and a transfer roller 36.

The photoreceptor drum 21, the charging section 22, the developing device 200, the cleaning unit 25, the toner cartridge 300, the toner supply pipe 250, and the intermediate transfer roller 34 are disposed for each color to correspond to image information of each color of black (b), cyan (c), magenta (m), and yellow (y) included in color image information. In this specification, in a case where four members corresponding to the colors, respectively, are discriminated, a letter representing each color is attached to the end of a numeral representing each member and this is used as a reference numeral, and in a case where each of the members are collectively referred to, only the numeral representing each of the members is used as a reference numeral.

The photoreceptor drum 21 is supported by a driving unit (not shown) so as to be rotatable around an axial line thereof, and includes a conductive substrate (not shown), and a photoconductive layer formed on a surface of the conductive substrate.

The charging section 22, the developing device 200, and the cleaning unit 25 are disposed in this order along the rotation direction of the photoreceptor drum 21, and the charging section 22 is disposed on a vertically lower side in relation to the developing device 200 and the cleaning unit 25.

The charging section 22 is a device that charges the surface of the photoreceptor drum 21 at predetermined polarity and potential. The charging section 22 is disposed at a position facing the photoreceptor drum 21 along the longitudinal direction of the photoreceptor drum 21.

The exposure unit 23 is disposed so that light emitted from the exposure unit 23 passes between the charging section 22 and the developing device 200 and the surface of the photoreceptor drum 21 is irradiated with the light.

The developing device 200 is a device that develops the electrostatic latent image formed on the photoreceptor drum 21 with a toner, and thereby forms a toner image on the photoreceptor drum 21. A toner supplying pipe 250 that is a cylindrical member is connected to the developing device 200 at a vertically upper part thereof. The details of the developing device 200 will be described later.

The toner cartridge 300 is displaced on a vertically upper side in relation to the developing device 200, and contains an unused toner. The toner supplying pipe 250 is connected to the toner cartridge 300 at a vertically lower part thereof. The toner cartridge 300 supplies the toner to the developing device 200 through the toner supplying pipe 250. The details of the toner cartridge 300 will be described later.

The cleaning unit 25 is a member that removes the toner remaining on the surface of the photoreceptor drum 21 after transferring the toner image onto the intermediate transfer belt 31 from the photoreceptor drum 21 and thereby cleans the surface of the photoreceptor drum 21.

According to the toner image forming section 20, the surface of the photoreceptor drum 21, that is in a uniformly charged state by the charging section 22, is irradiated with laser light corresponding to image information from the exposure unit 23, and thereby an electrostatic latent image is formed thereon. The toner is supplied to the electrostatic latent image on the photoreceptor drum 21 from the developing device 200, and thereby a toner image is formed. The toner image is transferred onto the intermediate transfer belt 31 described later. After the toner image is transferred onto the intermediate transfer belt 31, the toner remaining on the surface of the photoreceptor drum 21 is removed by the cleaning unit 25.

The intermediate transfer belt 31 is an endless belt-like member disposed vertically above the photoreceptor drum 21. The intermediate transfer belt 31 is supported around a driving roller 32 and a driven roller 33 with tension and forms a loop-like pathway, and runs in a direction indicated by an arrow A4.

The driving roller 32 is disposed to be rotatable around a axial line thereof by a driving unit (not shown). The driving roller 32 allows the intermediate transfer belt 31 to run in the direction indicated with the arrow A4 by rotation thereof. The driven roller 33 is provided to be rotatable in accordance with rotation of the driving roller 32, and generates a constant tension to the intermediate transfer belt 31 so that the intermediate transfer belt 31 does not go slack.

The intermediate transfer roller 34 is provided to come into pressure-contact with the photoreceptor drum 21 with the intermediate transfer belt 31 interposed therebetween and to be rotatable around an axial line thereof by a driving unit (not shown). As the intermediate transfer roller 34, for example, a roller member including a conductive elastic member on a surface of a metal (for example, stainless steel) roller having a diameter of 8 to 10 mm may be used. The intermediate transfer roller 34 is connected to a power source (not shown) that applies a transfer bias and has a function of transferring the toner image formed on the surface of the photoreceptor drum 21 to the intermediate transfer belt 31.

The transfer roller 36 is provided to come into pressure-contact with the driving roller 32 with the intermediate transfer belt 31 interposed therebetween, and to be rotatable around an axial line thereof by a driving unit (not shown). At a pressure-contact portion (transfer nip region) between the transfer roller 36 and the driving roller 32, the toner image borne on and conveyed by the intermediate transfer belt 31 is transferred onto a recording medium fed from the recording medium feeding section 50 described later.

The transfer belt cleaning unit 35 is provided to be opposite to the driven roller 33 in relation to the intermediate transfer belt 31, and to come into contact with a toner bearing surface of the intermediate transfer belt 31. The transfer belt cleaning unit 35 is provided to remove the toner on the surface of the intermediate transfer belt 31 and recovers the removed toner after the transfer of the toner image onto the recording medium.

According to the transfer section 30, when the intermediate transfer belt 31 runs while being brought into contact with the photoreceptor drum 21, a transfer bias with a polarity opposite to the charging polarity of the toner on the surface of the photoreceptor drum 21 is applied to the intermediate transfer roller 34, and the toner image formed on the surface of the photoreceptor drum 21 is transferred onto the intermediate transfer belt 31. The toner images of the respective colors formed by the photoreceptor drum 21*y*, the photoreceptor drum 21*m*, the photoreceptor drum 21*c*, and the photoreceptor drum 21*b* are sequentially overlaid and transferred onto the intermediate transfer belt 31 in this order and thereby a full color toner image is formed. The toner image transferred onto the intermediate transfer belt 31 is conveyed to the transfer nip region by running of the intermediate transfer belt 31 and is transferred onto a recording medium at the transfer nip region. The recording medium having the toner image transferred thereto is conveyed to the fixing section 40 described later.

The recording medium feeding section 50 includes a paper feed box 51, pick-up rollers 52*a* and 52*b*, conveying rollers 53*a* and 53*b*, registration rollers 54, and a paper feed tray 55. The paper feed box 51 is a container-like member that is provided at a vertically lower part of the image forming apparatus 100 and stores recording mediums at the inside of the image forming apparatus 100. The paper feed tray 55 is a tray-like member that is provided in a side wall surface of the image forming apparatus 100 and stores recording mediums at the outside of the image forming apparatus 100.

The pick-up roller 52*a* is a member that takes out the recording mediums stored in the paper feed box 51 one by one and feeds it to a paper conveyance path A1. The conveying rollers 53*a* are a pair of roller-like members, which are provided to come into pressure-contact with each other, and convey the recording medium in the paper conveyance path A1 toward the registration rollers 54. The pick-up roller 52*b* is a member that takes out the recording mediums stored in the paper feed tray 55 one by one and feeds it to a paper conveyance path A2. The conveying rollers 53*b* are a pair of roller-like members, which are provided to come into pressure-contact with each other, and convey the recording medium in the paper conveyance path A2 toward the registration rollers 54.

The registration rollers 54 are a pair of roller-like members, which are provided to come into pressure-contact with each other, and feeds the recording medium fed from the conveying rollers 53*a* or 53*b* to the transfer nip region in synchronization with conveyance of the toner image borne on the intermediate transfer belt 31 to the transfer nip region.

According to the recording medium feeding section 50, in synchronization with conveyance of the toner image borne on the intermediate transfer belt 31 to the transfer nip region, the recording medium is fed to the transfer nip region from the paper feed box 51 or the paper feed tray 55 and then the toner image is transferred onto the recording medium.

The fixing section 40 includes a heating roller 41 and a pressure roller 42. The heating roller 41 is controlled to maintain a predetermined fixing temperature. The pressure roller 42 is a roller that comes into pressure-contact with the heating roller 41. The heating roller 41 nips the recording medium together with the pressure roller 42 while heating the recording medium, and melts toner constituting the toner image and fixes it onto the recording medium. The recording medium having the toner image fixed thereon is conveyed to the discharge section 60 described later.

The discharge section 60 includes conveying rollers 61, discharge rollers 62, and a catch tray 63. The conveying rollers 61 are a pair of roller-like members, which are provided to come into pressure-contact with each other on a vertically upper side of the fixing section 40. The conveying rollers 61 convey the recording medium having an image fixed thereon toward the discharge rollers 62.

The discharge rollers 62 are a pair of roller-like members, which are provided to come into pressure-contact with each other. In the case of one-sided printing, the discharge rollers 62 discharge the recording medium on which the one-sided printing is completed to the catch tray 63. In the case of double-sided printing, the discharge rollers 62 convey the recording medium on which the one-sided printing is completed to the registration rollers 54 through a paper conveyance path A3 and discharges the recording medium on which the double-sided printing is completed to the catch tray 63. The catch tray 63 is provided in the vertically top surface of the image forming apparatus 100 and stores the recording mediums having the image fixed thereon.

The image forming apparatus 100 includes the control unit section (not shown). The control unit section is provided in the vertically upper part of the internal space of the image forming apparatus 100 and includes a memory portion, a computing portion, and a control portion. To the memory portion, various setting values mediated through an operation panel (not shown) disposed on the vertically upper surface of the image forming apparatus 100, the results detected by sensors (not shown) disposed in various portions inside the image forming apparatus 100, image information from an external device and the like are inputted. Moreover, programs for executing various processes are written in the memory portion. Examples of the various processes include a recording medium determination process, an attachment amount control process, and a fixing condition control process.

As for the memory portion, memories customarily used in this technical field can be used, and examples thereof include a read-only memory (ROM), a random-access memory (RAM), and a hard disc drive (HDD).

The computing portion takes out various kinds of data (for example, image formation commands, detection results, and image information) written in the memory portion and the programs for various processes and then makes various determinations. The control portion sends a control signal to the respective devices provided in the image forming apparatus 100 in accordance with the determination result by the computing portion, thus performing control on operations.

The control portion and the computing portion include a processing circuit which is realized by a microcomputer, a microprocessor, and the like having a central processing unit (CPU). The control unit section includes a main power source as well as the processing circuit. The power source supplies electricity to not only the control unit section but also to respective devices provided in the image forming apparatus 100.

Figure 2:
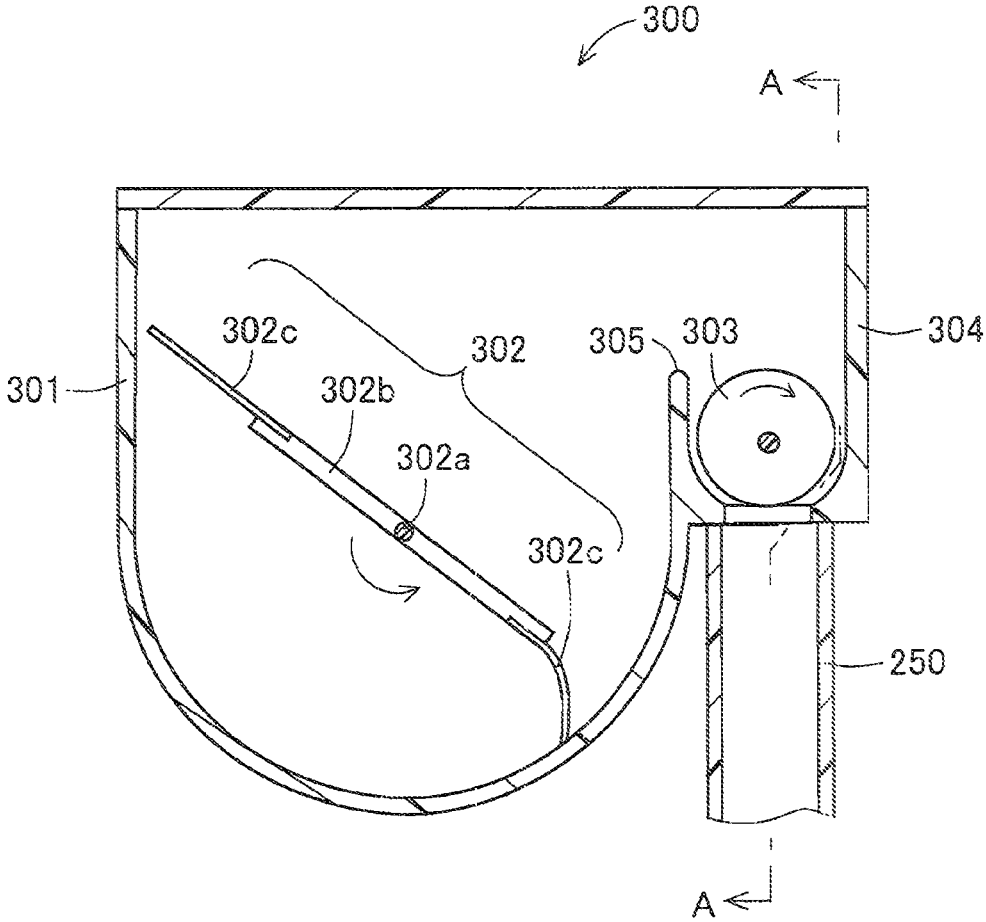
FIG. 2 is a schematic view illustrating a configuration of a toner cartridge.
Figure 3:
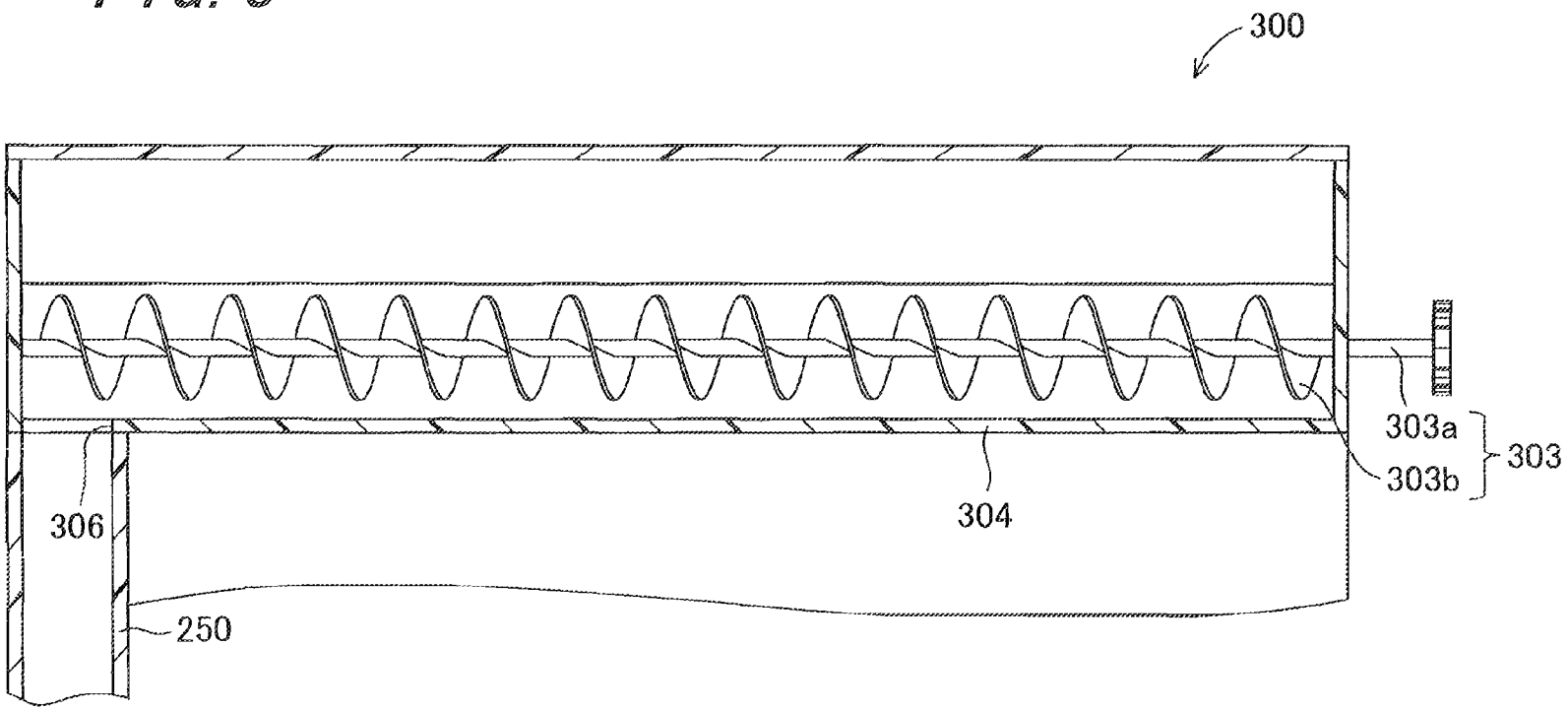
FIG. 3 is a cross-sectional view of the toner cartridge taken along the line A-A shown in FIG. 2.

FIG. 2 is a schematic view illustrating a configuration of the toner cartridge 300. FIG. 3 is a cross-sectional view of the toner cartridge 300 taken along the line A-A shown in FIG. 2. The toner cartridge 300 is a device that supplies a toner to the developing device 200 through the toner supply pipe 250. The toner cartridge 300 includes a toner container 301, a toner scooping member 302, a toner discharge member 303 and a toner discharge container 304.

The toner container 301 is a container-like member having an approximately semicircular columnar internal space, and in the internal space, supports the toner scooping member 302 so as to freely rotate and contains an unused toner. The toner discharge container 304 is a container-like member having an approximately semicircular columnar internal space provided along a longitudinal direction of the toner container 301, and in the internal space, supports the toner discharge member 303 so as to freely rotate. The internal space of the toner container 301 and the internal space of the toner discharge container 304 communicate with each other through a communicating opening 305 formed along the longitudinal direction of the toner container 301. The toner discharge container 304 has a discharge port 306 formed on a vertically lower part thereof. To the discharge port 306 of the toner discharge container 304, the toner supply pipe 250 is connected.

The toner scooping member 302 includes a rotation shaft 302*a*, a base member 302*b* and a sliding section 302*c*. The rotation shaft 302*a* is a column-shaped member extending along a longitudinal direction of the toner container 301. The base member 302*b* is a plate-like member extending along the longitudinal direction of the toner container 301, and attached to the rotation shaft 302*a* at a center in a width direction and a thickness direction thereof. The sliding section 302*c* is a member having flexibility and attached to both end parts in the width direction of the base member 302*b*, and is formed of, for example, a polyethylene terephthalate (PET). The toner scooping member 302 scoops the toner inside the toner container 301 into the toner discharge container 304 by which the base member 302*b* performs rotation motion following rotation of the rotation shaft 302*a* around the axial line thereof, whereby the sliding section 302*c* provided at the both end parts in the width direction of the base member 302*b* slides on an inner wall face of the toner container 301.

The toner discharge member 303 is a member that conveys the toner inside the toner discharge container 304 toward the discharge port 306. The toner discharge member 303 is a so-called auger screw including a toner discharge rotation shaft 303*a*, and a toner discharge blade 303*b* provided around the toner discharge rotation shaft 303*a*.

According to the toner cartridge 300, an unused toner in the toner container 301 is scooped into the toner discharge container 304 by the toner scooping member 302. Then, the toner scooped by the toner discharge container 304 is conveyed to the discharge port 306 by the toner discharge member 303. The toner conveyed to the discharge port 306 is discharged from the discharge port 306 to the outside of the toner discharge container 304, and supplied to the developing device 200 through the toner supply pipe 250.

Figure 4:
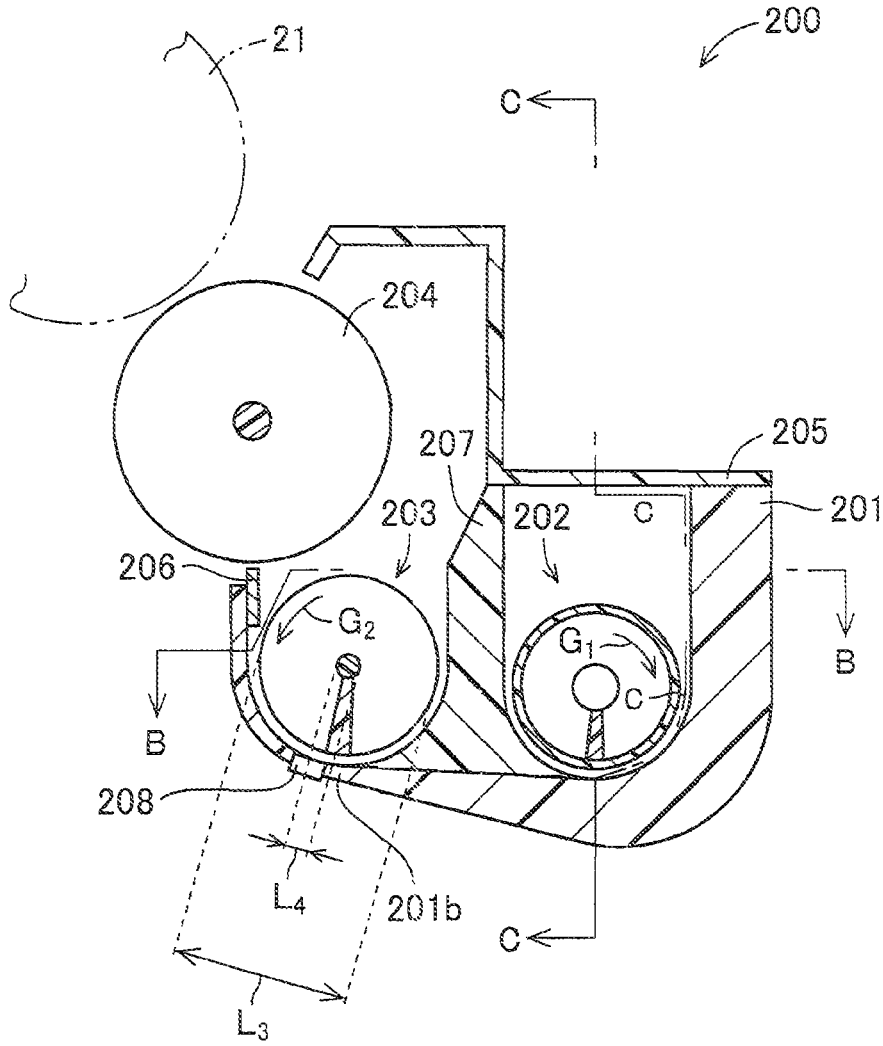
FIG. 4 is a schematic view illustrating a configuration of a developing device.
Figure 5:
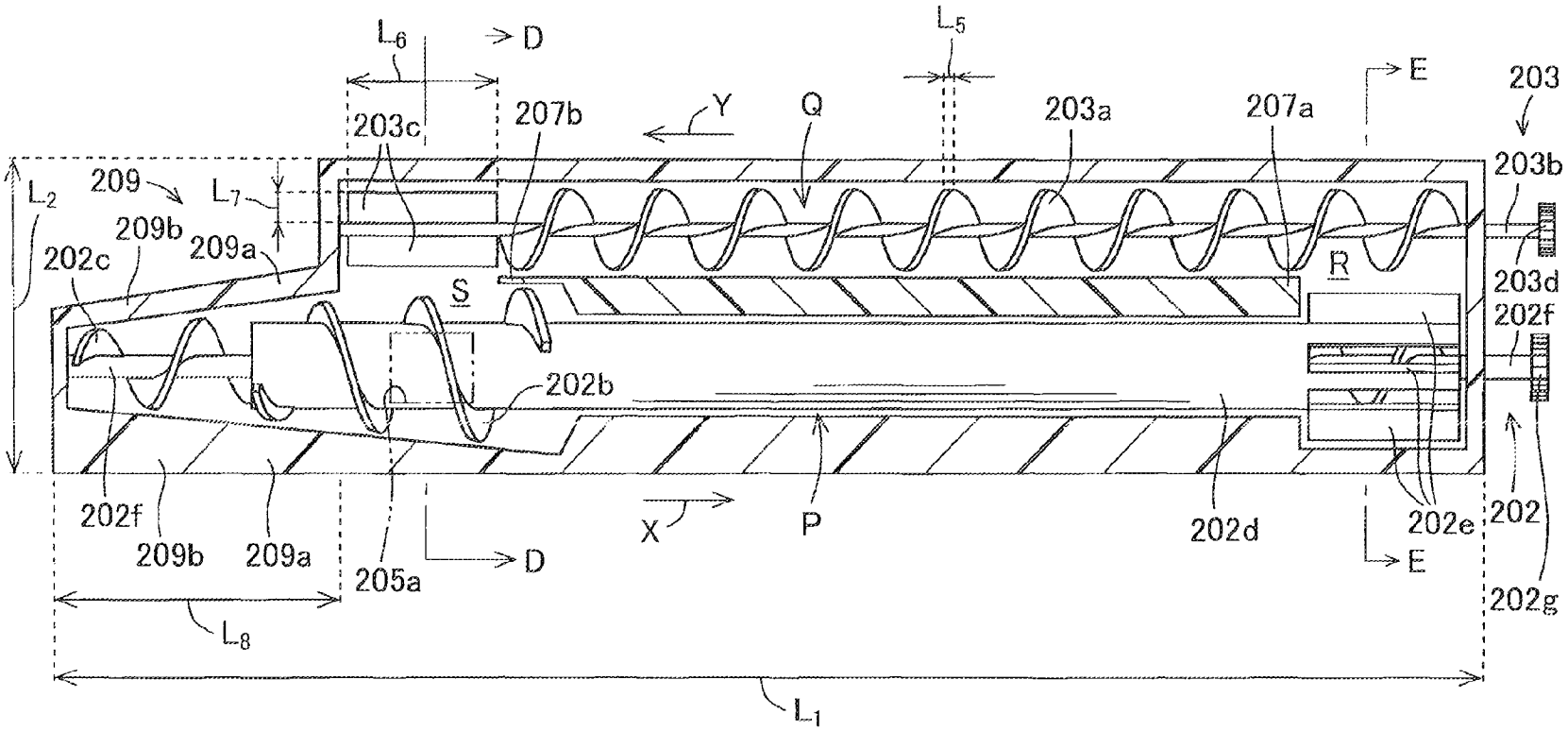
FIG. 5 is a cross-sectional view of the developing device taken along the line B-B shown in FIG. 4.
Figure 6:
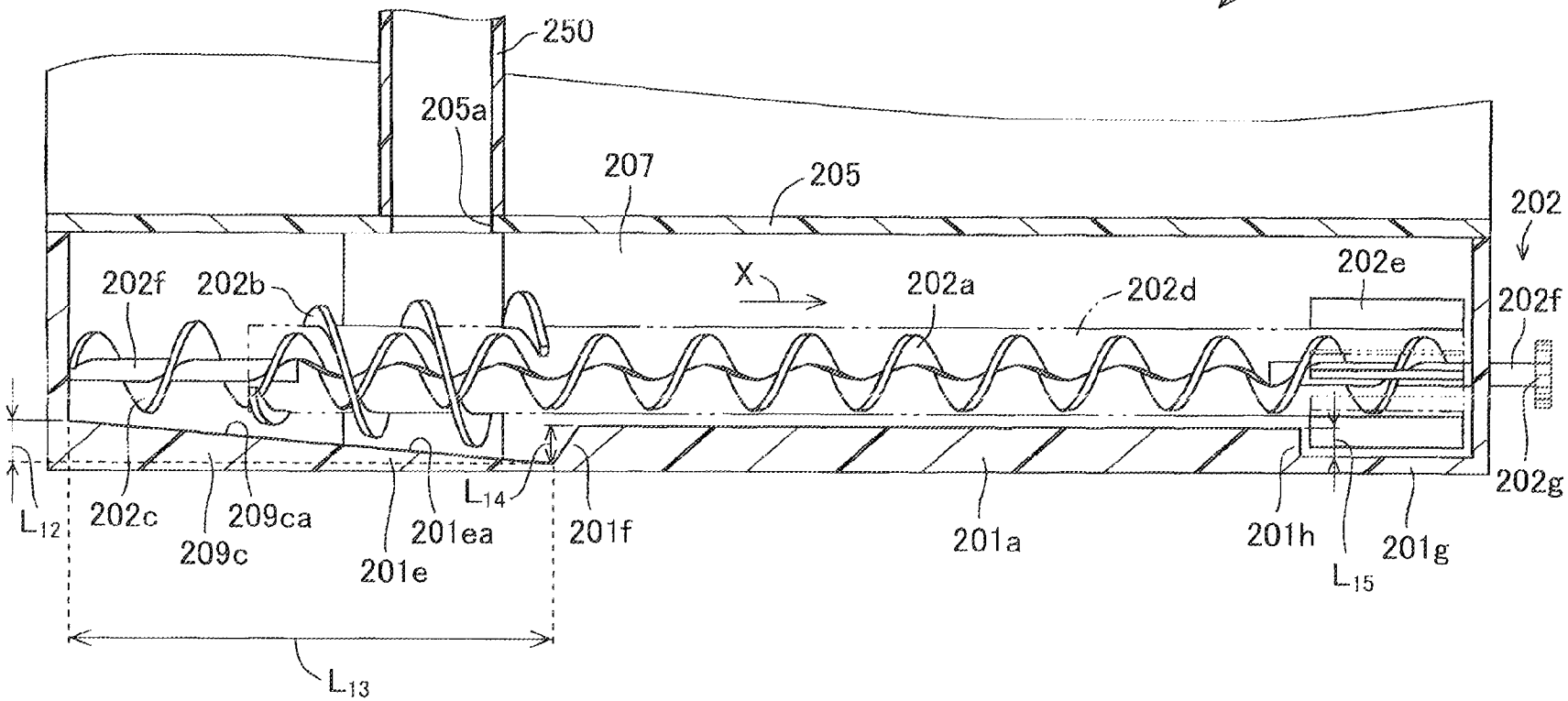
FIG. 6 is a cross-sectional view of the developing device taken along the line C-C shown in FIG. 4.
Figure 7:
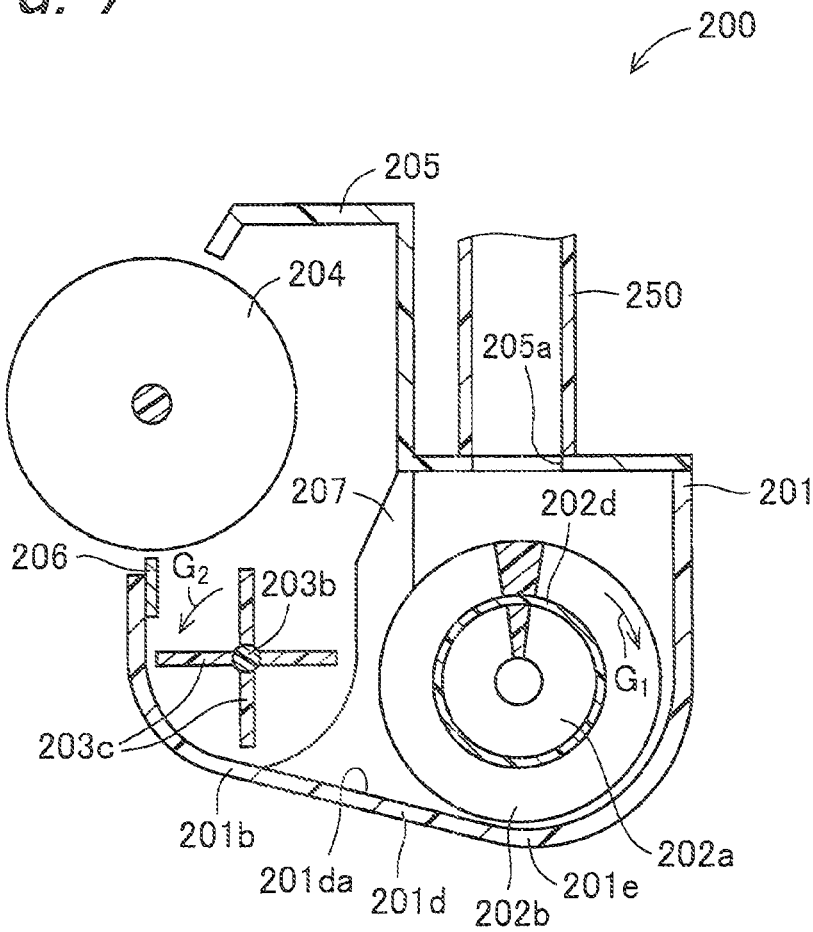
FIG. 7 is a cross-sectional view of the developing device taken along the line D-D shown in FIG. 5.
Figure 8:
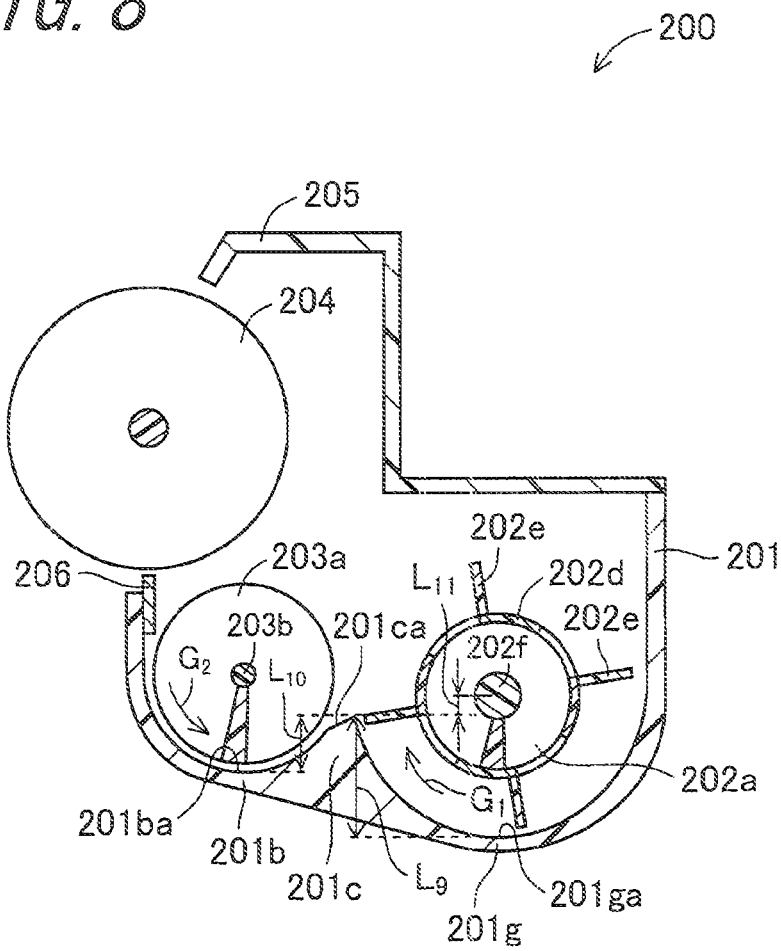
FIG. 8 is a cross-sectional view of the developing device taken along the line E-E shown in FIG. 5.

FIG. 4 is a schematic view illustrating a configuration of the developing device 200. FIG. 5 is a cross-sectional view of the developing device 200 taken along the line B-B shown in FIG. 4. FIG. 6 is a cross-sectional view of the developing device 200 taken along the line C-C shown in FIG. 4. FIG. 7 is a cross-sectional view of the developing device 200 taken along the line D-D shown in FIG. 5. FIG. 8 is a cross-sectional view of the developing device 200 taken along the line E-E shown in FIG. 5. The developing device 200 is a device which supplies a toner onto a surface of the photoreceptor drum 21 so as to develop an electrostatic latent image formed on the surface thereof. The developing device 200 includes a developer tank 201, a first developer conveying section 202, a second developer conveying section 203, a developing roller 204, a developer tank cover 205, a doctor blade 206, a partition wall 207, a toner concentration detection sensor 208, and a auxiliary tank 209.

The developer tank 201 is a member having an internal space, and contains a developer in the internal space. The developer used in this embodiment may be a one-component developer composed only of a toner, or may be a two-component developer containing a toner and a carrier.

In the developer tank 201, the developer tank cover 205 is disposed on a vertically upper side, and in the internal space thereof, the first developer conveying section 202, the second developer conveying section 203, the developing roller 204, the doctor blade 206, and the partition wall 207 are disposed. Further, in a vertically lower part (bottom part) of the developer tank 201, the toner concentration detection sensor 208 is disposed. Further, the developer tank 201 has an opening section between the photoreceptor drum 21 and the developing roller 204.

A length $L_1$ of the developer tank 201 in the longitudinal direction thereof falls within a range of about 350 mm to 450 mm. Moreover, a length $L_2$ of the developer tank 201 in a width direction thereof falls within a range of about 70 mm to 100 mm.

The developing roller 204 includes a magnet roller, and bears the developer inside the developer tank 201 on a surface thereof and supplies the toner contained in the borne developer to the photoreceptor drum 21. To the developing roller 204, a power source (not shown) is connected and a developing bias voltage is applied. The toner borne on the developing roller 204 is, in the vicinity of the photoreceptor drum 21, moved to the photoreceptor drum 21 with an electrostatic force by the developing bias voltage.

The doctor blade 206 is a plate-like member extending along an axial line direction of the developing roller 204, and is provided so that one end in a width direction thereof is fixed to the developer tank 201, and the other end thereof has a clearance with respect to the surface of the developing roller 204. The doctor blade 206 is provided so as to have a clearance with respect to the surface of the developing roller 204, and an amount of developer borne on the developing roller 204 is thereby regulated to a predetermined amount. As a material of the doctor blade 206, stainless steel, aluminum, a synthetic resin, or the like is usable.

The partition wall 207 is a member having a longitudinal shape extending along the longitudinal direction of the developer tank 201 at the substantially center portion of the developer tank 201 in the width direction thereof. The vertically upper part of the partition wall 207 is formed to be inclined with respect to the vertical direction so that the upper portion is made to be thin to prevent the retention of the developer. The partition wall 207 is provided between the bottom of the developer tank 201 and the developer tank cover 205 so that both longitudinal ends are spaced from an inner wall surface of the developer tank 201. Due to the partition wall 207, the internal space of the developer tank 201 is partitioned into a first conveying path P, a second conveying path Q, a first communication path R, and a second communication path S.

The second conveying path Q is an approximately semi-circular cylindrical space which extends along a longitudinal direction of the partition wall 207 and faces the developing roller 204. The first conveying path P is an approximately semi-circular cylindrical space which extends along the longitudinal direction of the partition wall 207 so that the partition wall 207 is between the first conveying path P and the second conveying path Q. The first communication path R is a space communicating with the first and second conveying paths P and Q on a side of one end 207*a* of the partition wall 207 in the longitudinal direction. The second communication path S is a space communicating with the first and second conveying paths P and Q on a side of the other end 207*b* of the partition 207 in the longitudinal direction.

The developer tank cover 205 is detachably disposed on a vertically upper side of the developer tank 201, and has a supply port portion 205*a*. To the developer tank cover 205, at the supply port portion 205*a*, the toner supply pipe 250 is connected. The supply port portion 205*a* is an opening portion defining an opening for supplying a toner into the developer tank 201. The toner contained in the toner cartridge 300 is supplied into the developer tank 201 through the toner supply pipe 250 and the opening.

The supply port portion 205*a* is situated vertically above a center portion of an outer spiral blade 202*b*, which will hereafter be described, in the longitudinal direction of the partition wall 207. The opening formed in the supply port portion 205*a* has substantially the shape of a rectangle, the long side of which is about 20 mm to 30 mm in length, and the short side of which is about 15 mm to 25 mm in length.

The first developer conveying section 202 is disposed inside the first conveying path P. The first developer conveying section 202 conveys the developer inside the developer tank 201 toward the side of the other end 207*a* of the partition wall 207 in the longitudinal direction from the side of the one end 207*b* of the partition wall 207 in the longitudinal direction. Hereinafter, a conveying direction of the developer by the first developer conveying section 202 is referred to as a conveying direction X.

The first developer conveying section 202 includes an inner spiral blade 202*a*, an outer spiral blade 202*b*, an upstream spiral blade 202*c*, a rotation tube 202*d*, a delivery portion 202*e*, support members 202*f*, and a first gear 202*g*. The first developer conveying section 202 extends along the conveying direction X, and has the columnar support members 202*f* at its upstream and downstream ends in the conveying direction X. Of the two support members 202*f*, the support member 202*f* located toward the second communication path S is rotatably supported on the inner wall of the auxiliary tank 209 which will hereafter be described. Of the two support members 202*f*, the support member 202*f* located toward the first communication path R is connected to the first gear 202*g* outside the developer tank 201.

The inner spiral blade 202*a* has a shape that is spirally wound on a side surface of an imaginary circular column extending along the conveying direction X, and rotates around the axial line of the imaginary circular column at 60 to 180 rpm in a rotation direction $G_1$ by a driving unit such as a motor via the support member 202*f* and the first gear 202*g*. With the rotation of the inner spiral blade 202*a*, the developer stored in the first conveying path P is, on the whole, conveyed downstream in the conveying direction X. Since the supply port portion 205*a* of the developer tank cover 205 is situated vertically above the outer spiral blade 202*b* of the first developer conveying section 202 disposed in the first conveying path P, it follows that unused toner stored in the toner cartridge 300 is firstly supplied to the first conveying path P, and is whereafter conveyed toward the downstream side in the conveying direction X of the first conveying path P by the first developer conveying section 202.

The rotation tube 202*d* is a hollow member which surrounds the outer circumference of the inner spiral blade 202*a*, and rotates with the inner spiral blade 202*a*. The rotation tube 202*d* extends along the conveying direction X, and has holes formed at its upstream and downstream ends in the conveying direction X.

The outer spiral blade 202*b* is fixed to the upstream side in the conveying direction X of the outer periphery of the rotation tube 202*d*. In this embodiment, the outer spiral blade 202*b* is positioned so as to face the second communication path S. As the outer spiral blade 202*b* rotates with the rotation tube 202*d*, the developer existing outside the rotation tube 202*d*, and more specifically the developer existing in the vicinity of the outer periphery of the rotation tube 202*d* is conveyed upstream in the conveying direction X. In this way, the outer spiral blade 202*b* guides the developer existing outside the rotation tube 202*d* into the hole formed at the upstream end in the conveying direction X of the rotation tube 202*d*. The developer which has been guided into the hole is then conveyed downstream in the conveying direction X by the inner spiral blade 202*a*.

The upstream spiral blade 202*c* is continuous with the upstream side in the conveying direction X of the inner spiral blade 202*a*. As the upstream spiral blade 202*c* rotates with the inner spiral blade 202*a*, the developer existing outside the rotation tube 202*d*, and more specifically the developer existing in the vicinity of the hole formed at the upstream end in the conveying direction X of the rotation tube 202*d* is conveyed downstream in the conveying direction X. In this way, the upstream spiral blade 202*c* guides the developer existing outside the rotation tube 202*d* into the hole formed at the upstream end in the conveying direction of the rotation tube 202*d*. The developer which has been guided into the hole is then conveyed downstream in the conveying direction X by the inner spiral blade 202*a*.

The delivery portion 202*e* is fixed to the downstream side in the conveying direction of the outer periphery of the rotation tube 202*d*. As the delivery portion 202*e* rotates with the rotation tube 202*d*, the developer existing outside the rotation tube 202*d*, and more specifically the developer existing in the vicinity of the hole formed at the downstream end in the conveying direction of the rotation tube 202*d* is delivered to the first communication path R. In this embodiment, as the inner spiral blade 202*a* is rotated in the rotation direction $G_1$, the delivery portion 202*e* is, in a position opposed to the first communication path R, moved in a vertical upwards direction to scoop the developer up and deliver it to the first communication path R. The developer which has been delivered to the first communication path R travels, through the first communication path R, to the second conveying path Q.

The second developer conveying section 203 is disposed inside the second conveying path Q. The second developer conveying section 203 conveys the developer inside the developer tank 201 from the side of the one end 207*a* to the side of the other end 207*b* of the partition wall 207 in the longitudinal direction. Hereinafter, a conveying direction of the developer by the second developer conveying section 203 is referred to as a conveying direction Y.

The second developer conveying section 203 includes a second spiral blade 203*a*, a rotation shaft member 203*b*, four circumferential rotation plates 203*c* and a second gear 203*d*. The rotation shaft member 203*b* is a cylindrical member which extends along the conveying direction Y, one end thereof in the longitudinal direction is connected to the second gear 203*d* outside the developer tank 201, and the other end thereof in the longitudinal direction is rotatably supported by the inner wall of the developer tank 201. In this embodiment, the axial line of the rotation shaft member 203*b* is situated vertically above a level of the axial line of the imaginary circular column surrounded by the inner spiral blade 202*a*.

The second spiral blade 203*a* has a shape that is spirally wound on a side surface of the rotation shaft member 203*b*, and rotates around an axial line of the rotation shaft member 203*b* in a rotational direction $G_2$ at 60 to 180 rpm by a driving unit such as a motor via the rotation shaft member 203*b* and the second gear 203*d*. The developer stored in the second conveying path Q is conveyed to a downstream side in the conveying direction Y by rotation of the second spiral blade 203*a*.

The four circumferential rotation plates 203*c* are composed of rectangular flat plates in the same shape, and long side portions thereof are fixed to the rotation shaft member 203*b*. The four circumferential rotation plates 203*c* are fixed to the rotation shaft member 203*b* so that main surfaces of the two neighboring circumferential rotation plates 203*c* are orthogonal to each other, and rotates with the second spiral blade 203*a* around an axial line of the rotation shaft member 203*b* in the rotation direction $G_2$. The developer conveyed from an upstream side in the conveying direction Y in the second conveying path Q is forced to the side of the second communication path S by rotation of the circumferential rotation plates 203*c*, and moves into the first conveying path P. Note that, as another embodiment, the second developer conveying section 203 may be an auger screw-like member without the circumferential rotation plates 203*c*.

A value of two times a distance from the axial line of the rotation shaft member 203*b* to a point, which is farthest from the axial line, on the second spiral blade 203*a* is referred to as an external diameter $L_3$ of the second spiral blade 203*a*. In addition, a value of two times a distance from the axial line of the rotation shaft member 203*b* to a point, which is nearest to the axial line, on the second spiral blade 203*a* is referred to as an internal diameter $L_4$ of the second spiral blade 203*a*. The external diameter $L_3$ of the second spiral blade 203*a* is settable as appropriate within a range of 20 mm or more and 40 mm or less, and the internal diameter $L_4$ of the second spiral blade 203*a* is settable as appropriate within a range of 5 mm or more and 15 mm or less. In addition, a thickness of $L_5$ of the second spiral blade 203*a* is settable as appropriate within a range of 1 mm or more and 3 mm or less. In addition, a length $L_6$ of the long side portion of the circumferential rotation plate 203*c* is settable as appropriate within a range of 20 mm or more and 40 mm or less, and a length $L_7$ of a short side portion of the circumferential rotation plate 203*c* is settable as appropriate within a range of 7 mm or more and 15 mm or less.

The auxiliary tank 209 is a member having an internal space. The internal space communicates with the upstream side in the conveying direction of the first conveying path P. The internal space of the auxiliary tank 209 has a substantially truncated cone shape which is tapered at its upstream side in the conveying direction X. The length $L_8$ of the auxiliary tank 209 in a longitudinal direction thereof falls within a range of about 40 mm to 60 mm.

The rotation tube 202*d* of the first developer conveying section 202 extends to the internal space of the auxiliary tank 209. The auxiliary tank 209 includes a first peripheral wall part 209*a* which is made to conform to the outer circumference of the outer spiral blade 202*b* fixed to the rotation tube 202*d*, with a spacing of about 1 mm to 2 mm secured between the first peripheral wall part 209*a* and the outer circumference of the outer spiral blade 202*b*. Also, the auxiliary tank 209 includes a second peripheral wall part 209*b* which is made to conform to the outer circumference of the upstream spiral blade 202*c*, with a spacing of about 1 mm to 2 mm secured between the second peripheral wall part 209*b* and the outer circumference of the upstream spiral blade 202*c*. The first peripheral wall part 209*a* and the second peripheral wall part 209*b* are made continuous with each other.

The toner concentration detection sensor 208 is mounted in the bottom of the developer tank 201 on a vertically lower side of the second developer conveying section 203, and is disposed so that a sensing surface thereof is exposed to the second conveying path Q. The toner concentration detection sensor 208 is electrically connected to a toner concentration control section (not shown).

The toner concentration control section performs control of rotating a toner discharge member 303 of the toner cartridge 300 according to the toner concentration detecting result detected by the toner concentration detection sensor 208 and supplying the toner into the developer tank 201. More specifically, the toner concentration control section determines whether the toner concentration detecting result through the toner concentration detection sensor 208 is lower than a predetermined set value. In a case where it is determined that the toner concentration detecting result is lower than the predetermined set value, the toner concentration control section sends a control signal to a driving section which rotates the toner discharge member 303, and rotates the toner discharge member 303 for a predetermined period.

To the toner concentration detection sensor 208, a power source (not shown) is connected. The power source applies, to the toner concentration detection sensor 208, a driving voltage for driving the toner concentration detection sensor 208 and a control voltage for outputting the toner concentration detection result to the toner concentration control section. The application of the voltage to the toner concentration detection sensor 208 by the power source is controlled by a control unit (not shown).

As the toner concentration detection sensor 208, a general toner concentration detection sensor is usable, and examples thereof include a transmissive optical detection sensor, a reflective optical detection sensor, and a permeability detection sensor. Among the toner concentration detection sensors, it is preferable to use the permeability detection sensor. Examples of the permeability detection sensor include TS-L (trade name, manufactured by TDK corporation), TS-A (trade name, manufactured by TDK corporation), and TS-K (trade name, manufactured by TDK corporation).

Hereinafter, a part of the bottom of the developer tank 201 opposed to the first conveying path P will be referred to as a first conveying path bottom part 201*a*, a part thereof opposed to the second conveying path Q will be referred to as a second conveying path bottom part 201*b*, a part thereof opposed to the first communication path R will be referred to as a first communication path bottom part 201*c*, and a part thereof opposed to the second communication path S will be referred to as a second communication path bottom part 201*d*.

Moreover, a part of the bottom of the developer tank 201 opposed to the upstream region in the conveying direction X of the first conveying path P will be referred to as a first conveying path-upstream region bottom part 201*e*, and a part between the first conveying path-upstream region bottom part 201*e* and the first conveying path bottom part 201*a* will be referred to as an upstream barrier part 201*f*. Further, a part of the bottom of the developer tank 201 opposed to the downstream region in the conveying direction X of the first conveying path P will be referred to as a first conveying path-downstream region bottom part 201*g*, and a part between the first conveying path-downstream region bottom part 201*g* and the first conveying path bottom part 201*a* will be referred to as a downstream barrier part 201*h*. In addition, a part of the bottom of the auxiliary tank 209 which is adjacent to the first conveying path-upstream region bottom part 201*e* at a location upstream from the first conveying path-upstream region bottom part 201*e* in the conveying direction X will be referred to as an auxiliary tank bottom part 209*c*.

The vertically upper surface of the first conveying path bottom part 201*a*, as well as the vertically upper surface of the second conveying path bottom part 201*b*, extends substantially horizontally. The axial line of the imaginary circular column surrounded by the inner spiral blade 202*a* extends along the vertically upper surface of the first conveying path bottom part 201*a*. The axial line of the rotation shaft member 203*b* extends along the vertically upper surface of the second conveying path bottom part 201*b*.

The first communication path bottom part 201*c* is situated between the first conveying path-downstream region bottom part 201*g* and the second conveying path bottom part 201*b*. The first communication path bottom part 201*c* is configured so as to extend along the vertical upwards direction with increasing distance from the first conveying path-downstream region bottom part 201*g* and the second conveying path bottom part 201*b*. A vertical distance $L_9$ between a vertically upper surface 201*ca* of the first communication path bottom part 201*c* and a vertically upper surface 201*ga* of the first conveying path-downstream region bottom part 201*g* is settable as appropriate within a range of 8 mm or more and 20 mm or less. A vertical distance $L_{10}$ between the vertically upper surface 201*ca* of the first communication path bottom part 201*c* and a vertically upper surface 201*ba* of the second conveying path bottom part 201*b* is settable as appropriate within a range of 5 mm or more and 15 mm or less.

Moreover, the vertically upper surface 201*ca* of the first communication path bottom part 201*c* is situated vertically below a level of the axial line of the imaginary circular column surrounded by the inner spiral blade 202*a*. A vertical distance $L_{11}$ between the vertically upper surface 201*ca* of the first communication path bottom part 201*c* and the axial line of the imaginary circular column surrounded by the inner spiral blade 202*a* is settable as appropriate within a range of 2 mm or more and 10 mm or less.

Further, the vertically upper surface 201*ca* of the first communication path bottom part 201*c* is formed with an inclination, with a side of the first conveying path P situated vertically above a level of a side of the second conveying path Q.

The second communication path bottom part 201*d* is situated between the first conveying path-upstream region bottom part 201*e* and the second conveying path bottom part 201*b*. A vertically upper surface 201*da* of the second communication path bottom part 201*d* is formed with an inclination, with a side of the second conveying path Q situated vertically above a level of a side of the first conveying path P.

A vertically upper surface 201*ea* of the first conveying path-upstream region bottom part 201*e* is formed with an inclination, with its upstream side in the conveying direction X situated vertically above a level of its downstream side in the conveying direction X. A vertically upper surface 209*ca* of the auxiliary tank bottom part 209*c* is continuous with the upstream side in the conveying direction X of the vertically upper surface 201*ea* of the first conveying path-upstream region bottom part 201*e*, and is formed with an inclination, with its upstream side in the conveying direction X situated vertically above the level of its downstream side in the conveying direction X. A vertical distance $L_{12}$ between the downstream end in the conveying direction X of the vertically upper surface 201*ea* of the first conveying path-upstream region bottom part 201*e* and the upstream end in the conveying direction X of the vertically upper surface 209*ca* of the auxiliary tank bottom part 209*c* is settable as appropriate within a range of 5 mm or more and 20 mm or less. A distance $L_{13}$ in the conveying direction X between the downstream end in the conveying direction X of the vertically upper surface 201*ea* of the first conveying path-upstream region bottom part 201*e* and the upstream end in the conveying direction X of the vertically upper surface 209*ca* of the auxiliary tank bottom part 209*c* is settable as appropriate within a range of 60 mm or more and 100 mm or less.

The upstream barrier part 201*f* is formed adjacent to the first conveying path-upstream region bottom part 201*e* at a location downstream from the first conveying path-upstream region bottom part 201*e* in the conveying direction X. Moreover, the upstream barrier part 201*f* extends along the vertical upwards direction so as to be situated vertically above a level of the first conveying path-upstream region bottom part 201*e*. A vertical distance $L_{14}$ between the first conveying path-upstream region bottom part 201*e* and the upstream barrier part 201*f* is settable as appropriate within a range of 7 mm or more and 15 mm or less.

The downstream barrier part 201*h* is formed adjacent to the first conveying path-downstream region bottom part 201*g* at a location upstream from the first conveying path-downstream region bottom part 201*g* in the conveying direction X. Moreover, the downstream barrier part 201*h* extends along the vertical upwards direction so as to be situated vertically above a level of the first conveying path-downstream region bottom part 201*g*. A vertical distance $L_{15}$ between the first conveying path-downstream region bottom part 201*g* and the downstream barrier part 201*h* is settable as appropriate within a range of 7 mm or more and 15 mm or less.

According to the developing device 200 configured in this manner, the developer is circulation-conveyed through the internal of the developer tank 201 in a circulation order composed of the first conveying path P, the first communication path R, the second conveying path Q, and the second communication path S. Part of the developer which is being circulation-conveyed is borne on the surface of the developing roller 204 in the second conveying path Q. Having reached the photoreceptor drum 21, toner constituents of the borne developer are consumed one after another. When the toner concentration detection sensor 208 senses the consumption of predetermined amounts of toner, then unused toner is supplied from the toner cartridge 300 into the first conveying path P. The supplied toner is conveyed in the first conveying path P while spreading into the existing developer in storage.

Figure 9:
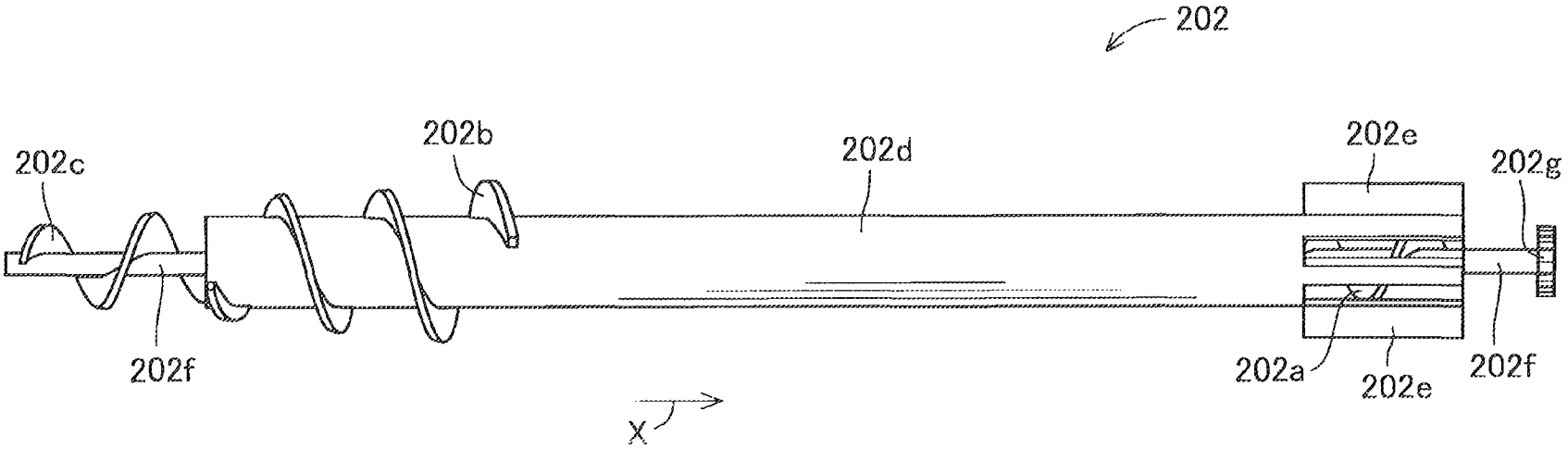
FIG. 9 is a schematic view showing a first developer conveying section as a whole.
Figure 10:
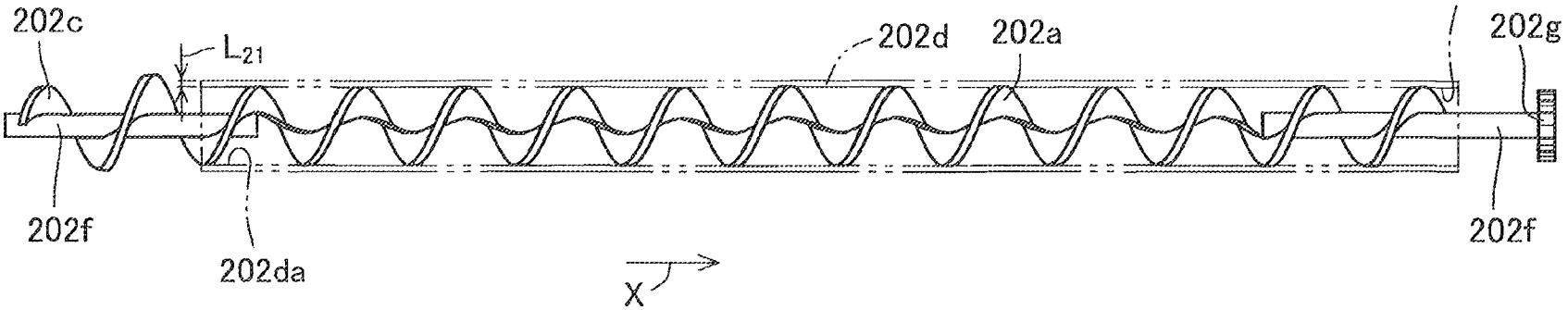
FIG. 10 is a schematic view showing an inside of a rotation tube.
Figure 11:
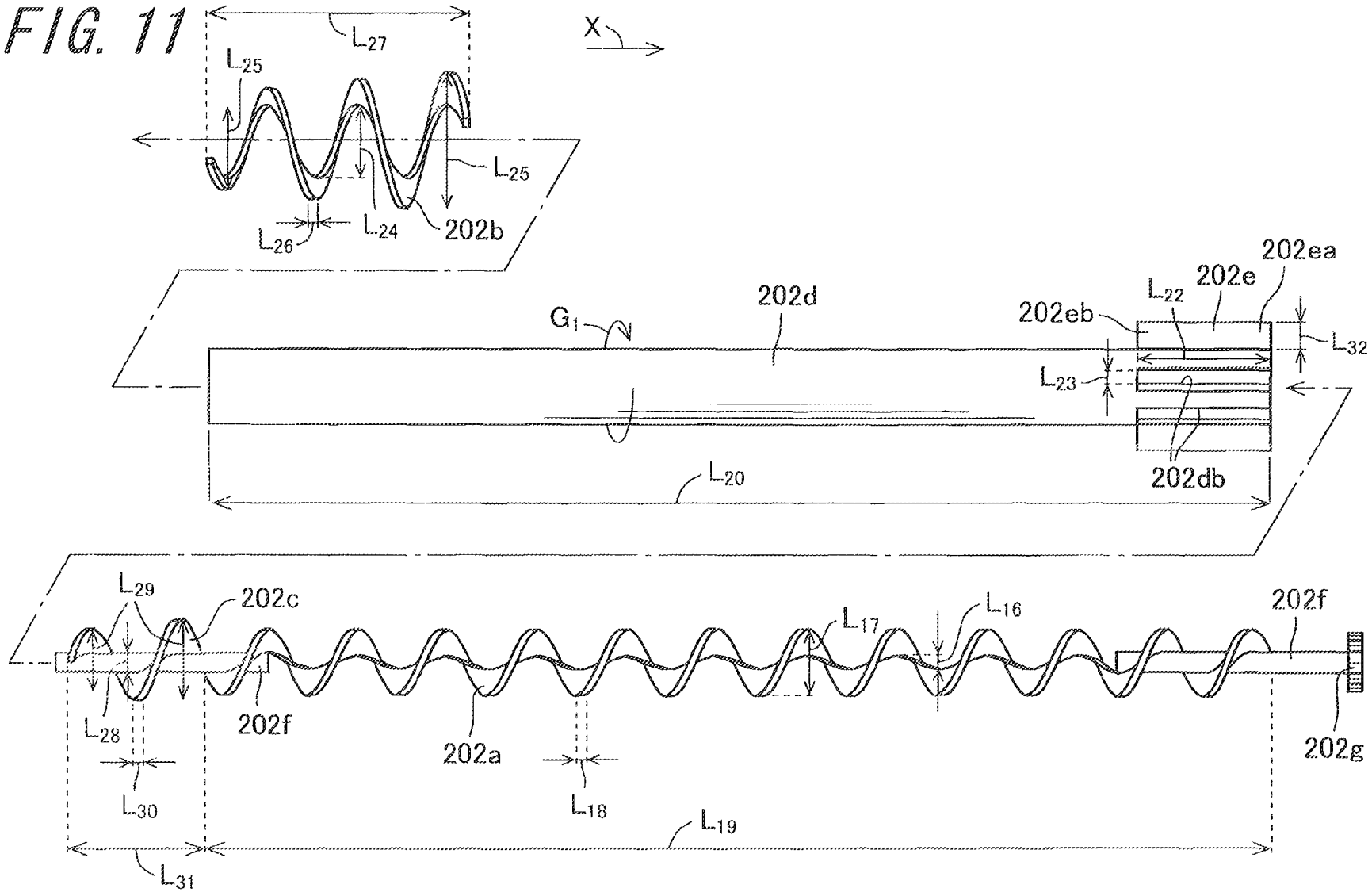
FIG. 11 is an exploded view of the first developer conveying section.

Now, a detailed description of the first developer conveying section 202 will be given below. FIG. 9 is a schematic view showing the first developer conveying section 202 as a whole. FIG. 10 is a schematic view showing an inside of the rotation tube 202*d*. FIG. 11 is an exploded view of the first developer conveying section 202. As has already been described, the first developer conveying section 202 includes the inner spiral blade 202*a*, the outer spiral blade 202*b*, the upstream spiral blade 202*c*, the rotation tube 202*d*, the delivery portion 202*e*, the support members 202*f*, and the first gear 202*g*.

The inner spiral blade 202*a*, the outer spiral blade 202*b*, the upstream spiral blade 202*c*, the rotation tube 202*d*, the delivery portion 202*e*, the support members 202*f*, and the first gear 202*g* are each made of a material such for example as polyethylene, polypropylene, high-impact polystyrene, and ABS resin (acrylonitrile-butadiene-styrene copolymer synthetic resin). In a case where the inner spiral blade 202*a*, the outer spiral blade 202*b*, the upstream spiral blade 202*c*, the rotation tube 202*d*, the delivery portion 202*e*, the support members 202*f*, and the first gear 202*g* are made of the same material, it is preferable that the first developer conveying section 202 is integrally formed.

In this embodiment, the inner spiral blade 202*a* is a continuous general spiral blade. In this embodiment, the "general spiral blade" approximately refers to a blade portion of an auger screw, and more specifically, refers to a member having a predetermined thickness and having a general spiral blade surface as a main surface. The general spiral blade surface is a curved surface corresponding to a spiral which is a curve, and details thereof will be described later.

In this embodiment, a "spiral" is a consecutive space curve on a side surface of an imaginary circular column, and a space curve that advances in one direction among axial line directions of the imaginary circular column while advancing in one direction among circumferential directions of the imaginary circular column. In the case of being viewed on the one direction among the axial line directions of the imaginary circular column, the spiral advancing in a right-handed direction among circumferential directions of the imaginary circular column while advancing in the one direction among the axial line directions of the imaginary circular column is referred to as being a right-handed spiral, whereas a spiral advancing in the left-handed direction while advancing in the one direction among the axial line directions of the imaginary circular column is referred to as being a left-handed spiral.

Further, among the spirals, a spiral whose lead angle is constant in all points on the spiral is especially referred to as a "general spiral". Here, an angle formed of a tangent line of the spiral at a certain point on the spiral and a straight line that is made by projecting the tangent line to a vertical plane with respect to the axial line direction of the imaginary circular column surrounded by the spiral is a "lead angle" at the point. The lead angle is an angle that is larger than 0° and smaller than 90°.

In this embodiment, the "general spiral blade surface" is a surface formed of the trajectory of one line segment $J_1$ outside an imaginary circular column $K_1$ (hereinafter a radius is $r_1$) when the line segment $J_1$ is moved in one direction $D_1$ parallel to the axial line of the imaginary circular column $K_1$ while maintaining a length $m_1$ of the line segment $J_1$ in a radial direction of the imaginary circular column $K_1$ and an attachment angle $\alpha$ of the line segment $J_1$ along one general spiral $C_1$ (hereinafter, a lead angle is constant at $\theta_1$) on a side surface of the imaginary circular column $K_1$. Here, the "attachment angle $\alpha$" is an angle formed by the line segment $J_1$ and a half-line extending along the one direction $D_1$ from a tangent point of the line segment $J_1$ and the imaginary circular column $K_1$ on a plane including the axial line of the imaginary circular column $K_1$ and the line segment $J_1$, and is an angle that is larger than 0° and smaller than 180°.

Figure 12A:
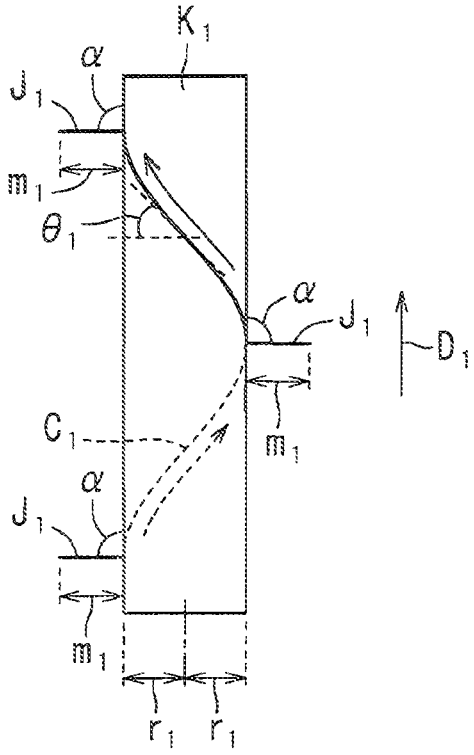
FIGS. 12A and 12B are views illustrating one cyclic general spiral blade surface.
Figure 12B:
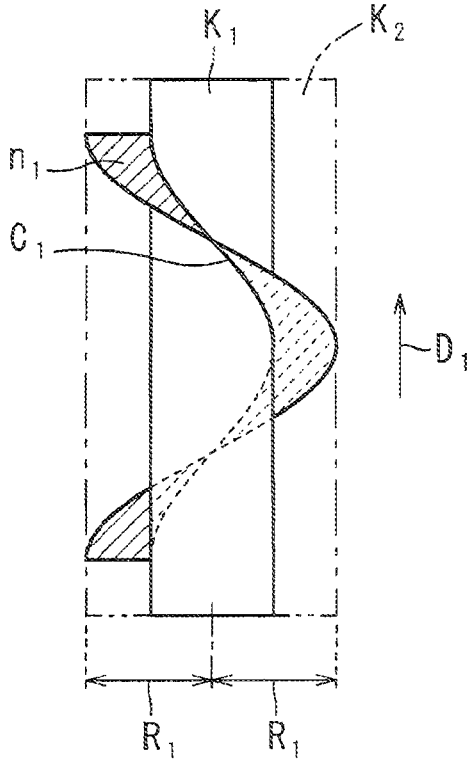

Hereinafter, as an example of the general spiral blade surface, a general spiral blade obtained when a line segment is moved along one cyclic portion of a general spiral (hereinafter, referred to as "one cyclic general spiral blade surface") is illustrated. FIGS. 12A and 12B are views illustrating one cyclic general spiral blade surface. FIG. 12A shows the side surface of the imaginary circular column $K_1$, the left-handed general spiral $C_1$ on the side surface of the imaginary circular column $K_1$, and the starting and ending positions of the line segment $J_1$ moving in one direction $D_1$ on the general spiral $C_1$. The line segment $J_1$ shown on the lowermost side of the sheet surface of FIG. 12A is the starting position of the moving line segment $J_1$, and the line segment $J_1$ shown on the uppermost side is the ending position. As shown in FIG. 12A, the trajectory of the line segment $J_1$ when the line segment $J_1$ is moved in one direction $D_1$ along the general spiral $C_1$ while constantly maintaining the length $m_1$ in the radial direction of the imaginary circular column $K_1$ and the attachment angle $\alpha$ ($\alpha$=90° in FIG. 12A) of the line segment $J_1$ corresponds to a general spiral blade surface $n_1$ shown in FIG. 12B. The surface depicted by a hatched portion in FIG. 12B is the general spiral blade surface $n_1$.

As shown in FIG. 12B, an outer circumferential portion of the general spiral blade surface $n_1$ becomes a left-handed general spiral that advances in the one direction $D_1$ on a side surface of an imaginary circular column $K_2$ whose axial line is identical with that of the imaginary circular column $K_1$. Here, the outer circumferential portion of the general spiral blade surface $n_1$ is a portion which is the most distant from the axial line of the imaginary circular column $K_1$ on the general spiral blade surface $n_1$. A radius $R_1$ of the imaginary circular column $K_2$ is equal to the sum of a radius $r_1$ of the imaginary circular column $K_1$ and the length $m_1$ of the line segment $J_1$ in the radial direction of the imaginary circular column $K_1$.

The member with such a general spiral blade surface as the main surface is the general spiral blade. In a case where the general spiral blade is used as the inner spiral blade 202*a* as in this embodiment, the general spiral blade is formed so that the general spiral blade surface $n_1$ is placed on the downstream side in the conveying direction X, and a developer is conveyed toward the downstream side in the conveying direction X by the general spiral blade surface $n_1$. In this embodiment, the rotation direction $G_1$ is the right-handed direction when viewed in the conveying direction X. Therefore, in order to convey the developer toward the downstream side in the conveying direction X by the general spiral blade surface $n_1$, the general spiral blade needs to be implemented as a member having, as its main surface, a general spiral blade surface defined by a line segment which has been drawn along a left-handed general spiral, namely, a left-handed general spiral blade.

Further, in a case where the general spiral blade is used as the inner spiral blade 202*a*, an internal diameter $L_{16}$ of the inner spiral blade 202*a* (general spiral blade) becomes a value of two times the radius $r_1$ of the imaginary circular column $K_1$ shown in FIG. 12A, and an external diameter $L_{17}$ thereof becomes a value of two times the radius $R_1$ of the imaginary circular column $K_2$ shown in FIG. 12B. Here, the internal diameter $L_{16}$ of the inner spiral blade 202*a* (general spiral blade) is a value of two times the distance between an inner circumferential portion of the inner spiral blade 202*a* (general spiral blade) and the axial line of the imaginary circular column $K_1$. The inner circumferential portion is a part on the inner spiral blade 202*a* (general spiral blade) in which the distance from the axial line of the imaginary circular column $K_1$ is the closest thereto in a cross section perpendicular to the axial line of the imaginary circular column $K_1$. Further, the external diameter $L_{17}$ of the inner spiral blade 202*a* (general spiral blade) is a value of two times the distance between the outer circumferential portion of the inner spiral blade 202*a* (general spiral blade) and the axial line of the imaginary circular column $K_1$. The outer circumferential portion is a part on the inner spiral blade 202*a* (general spiral blade) in which the distance from the axial line of the imaginary circular column $K_1$ is the most distant therefrom in the cross section perpendicular to the axial line of the imaginary circular column $K_1$.

The internal diameter $L_{16}$ of the inner spiral blade 202*a* is settable as appropriate within a range of 0 mm or more and 5 mm or less, for example, and the external diameter $L_{17}$ is settable as appropriate within a range of 10 mm or more and 30 mm or less, for example. Further, for example, the attachment angle $\alpha$ may not be 90°, and is settable as appropriate within a range of 30° or more and 150° or less. The lead angle $\theta_1$ is settable as appropriate within the range of 20° or more and 70° or less, for example. Further, a thickness $L_{18}$ of the inner spiral blade 202*a* is settable as appropriate within a range of 1 mm or more and 3 mm or less, and a length $L_{19}$ of the inner spiral blade 202*a* in the longitudinal direction thereof is settable as appropriate within a range of 300 mm or more and 400 mm or less.

It is noted that, in this embodiment, the support member 202*f* located toward the first communication path R is fixed to the downstream end in the conveying direction X of the inner circumference of the inner spiral blade 202*a*, and the external diameter of the support member 202*f* is set to be equal to the internal diameter $L_{16}$ of the inner spiral blade 202*a*.

Around the inner spiral blade 202*a*, the rotation tube 202*d* is fixedly attached so as to surround the outer circumference of the inner spiral blade 202*a*. Since the rotation tube 202*d* is fixed to the inner spiral blade 202*a*, the rotation tube 202*d* rotates with the inner spiral blade 202*a*.

The rotation tube 202*d* is a hollow circular columnar member extending along the conveying direction X. For example, a length $L_{20}$ of the rotation tube 202*d* in an axial direction thereof is settable as appropriate within a range of 300 mm or more and 400 mm or less. Moreover, a thickness $L_{21}$ of the rotation tube 202*d* as shown in FIG. 10 is constant, and is settable as appropriate within a range of 1 mm or more and 2 mm or less.

The rotation tube 202*d* has an admission port portion 202*da* formed at its upstream end in the conveying direction X, and also has a discharge port portion 202*db* and an outlet opening portion 202*dc* formed at its downstream end in the conveying direction X.

The admission port portion 202*da* is formed at the bottom surface of the upstream side in the conveying direction X of the columnar rotation tube 202*d*. The admission port portion 202*da* is formed with a substantially circular hole for providing communication between the internal space of the rotation tube 202*d* and the exterior space. In the developer tank 201, the developer existing outside the rotation tube 202*d* flows, through the hole formed in the admission port portion 202*da*, into the rotation tube 202*d*. Note that the admission port portion 202*da* may include two or more holes.

The discharge port portion 202*db* is formed at the downstream end in the conveying direction X of the side surface of the columnar rotation tube 202*d*. The discharge port portion 202*db* is formed with a hole for providing communication between the internal space of the rotation tube 202*d* and the exterior space. The hole formed in the discharge port portion 202*db*, when viewed in the conveying direction X, is disposed between one end 202*ea* in the conveying direction X and the other end 202*eb* in the conveying direction X of the delivery portion 202*e*. In other words, the length of the delivery portion 202*e* in the conveying direction X is equal to or greater than the length in the conveying direction X of the hole formed in the discharge port portion 202*db*.

In this embodiment, the hole formed in the discharge port portion 202*db* has a rectangular shape. A length $L_{22}$ of the rectangular hole in the conveying direction X is settable as appropriate within a range of 25 mm or more and 40 mm or less, for example. Moreover, a length $L_{23}$ of the rectangular hole in a circumferential direction of the rotation tube 202*d* is settable as appropriate within a range of 7 mm or more and 15 mm or less, for example.

Moreover, in this embodiment, the number of holes formed in the discharge port portion 202*db* is four. The four holes have the same shape, and are formed at regular intervals in the circumferential direction of the rotation tube 202*d*.

The outlet opening portion 202*dc* is formed at the bottom surface of the downstream side in the conveying direction X of the columnar rotation tube 202*d*. The outlet opening portion 202*dc* is formed with a substantially circular hole for providing communication between the internal space of the rotation tube 202*d* and the exterior space.

The developer existing inside the rotation tube 202*d* flows out of the rotation tube 202*d* through the hole formed in the discharge port portion 202*db* or the hole formed in the outlet opening portion 202*dc*.

The outer spiral blade 202*b*, the upstream spiral blade 202*c*, and the delivery portion 202*e* are disposed outside such a rotation tube 202*d*. The outer spiral blade 202*b* is fixed to the upstream end in the conveying direction X of the side surface of the rotation tube 202*d*. The upstream spiral blade 202*c* is made continuous with the upstream end in the conveying direction X of the inner spiral blade 202*a*. The delivery portion 202*e* is fixed to the downstream end in the conveying direction X of the side surface of the rotation tube 202*d*.

The outer spiral blade 202*b* rotates with the inner spiral blade 202*a* and the rotation tube 202*d*. With the rotation, the developer existing outside the rotation tube 202*d* is guided to the admission port portion 202*da*. The outer spiral blade 202*b* has a shape which has a constant internal diameter and an external diameter which becomes small continuously as it advances on the upstream side in the conveying direction X. Expressed differently, the outer spiral blade 202*b* has a shape which has a constant internal diameter and an external diameter which becomes large continuously as it advances on the downstream side in the conveying direction X.

In the embodiment, the outer spiral blade 202*b* is a continuous cone-shaped general spiral blade. In this embodiment, the "cone-shaped general spiral blade" is schematically a member in a shape in which an external diameter is continuously changed while maintaining an internal diameter constant in a general spiral blade. More specifically, the cone-shaped general spiral blade is a member with a predetermined thickness having a cone-shaped general spiral blade surface as described below as a main surface.

In this embodiment, the "cone-shaped general spiral blade surface" is a surface formed by the trajectory of one line segment $J_2$ outside an imaginary circular column $K_3$ (hereinafter, a radius is $r_2$) when the line segment $J_2$ is moved in one direction $D_2$ parallel to an axial line of the imaginary circular column $K_3$ while changing so that a length $m_2$ of the line segment $J_2$ in a radial direction of the imaginary circular column $K_3$ continuously becomes larger and maintaining an attachment angle β of the line segment $J_2$ along one general spiral $C_2$ (a lead angle is $\theta_2$) on a side surface of the imaginary circular column $K_3$. Here, the "attachment angle β" is an angle formed by the line segment $J_2$ and a half-line extending along the one direction $D_2$ from a tangent point of the line segment $J_2$ and the imaginary circular column $K_3$ on a plane including the axial line of the imaginary circular column $K_3$ and the line segment $J_2$, and is an angle that is larger than 0° and smaller than 180°.

Figure 13A:
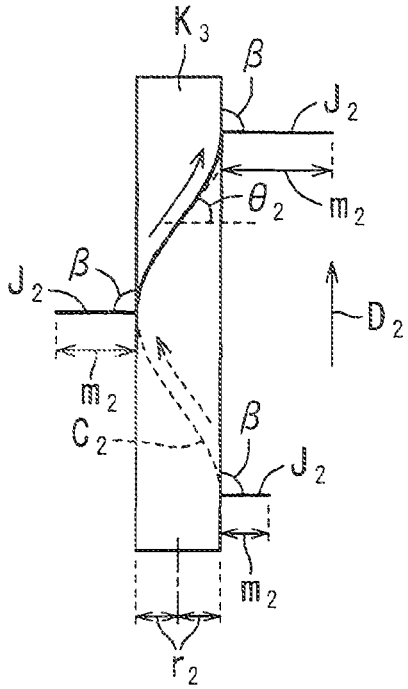
FIGS. 13A to 13D are views illustrating one cyclic cone-shaped general spiral blade surface.

Hereinafter, as an example of the cone-shaped general spiral blade surface, a cone-shaped general spiral blade surface obtained when a line segment is moved along one cyclic portion of a general spiral (hereinafter, referred to as "one cyclic cone-shaped general spiral blade surface") is illustrated. FIGS. 13A to 13D are views illustrating the one cyclic cone-shaped general spiral blade surface. FIG. 13A shows a side surface of the imaginary circular column $K_3$, a right-handed general spiral $C_2$ on the side surface of the imaginary circular column $K_3$, and starting and end positions of the line segment $J_2$ moving in the one direction $D_2$ on the general spiral $C_2$. The line segment $J_2$ shown on the lowermost side of the sheet of FIG. 13A indicates the starting position in moving, and the line segment $J_2$ shown on the uppermost side indicates the end position. As shown in FIG. 13A, the trajectory of the line segment $J_2$ when the line segment $J_2$ is moved in the one direction $D_2$ along the general spiral $C_2$ while changing so that a length $m_2$ of the line segment $J_2$ in a radial direction of the imaginary circular column $K_3$ continuously becomes larger and constantly maintaining the attachment angle β (β=90° in FIG. 13A) of the line segment $J_2$ corresponds to a cone-shaped general spiral blade surface.

Figure 13B:
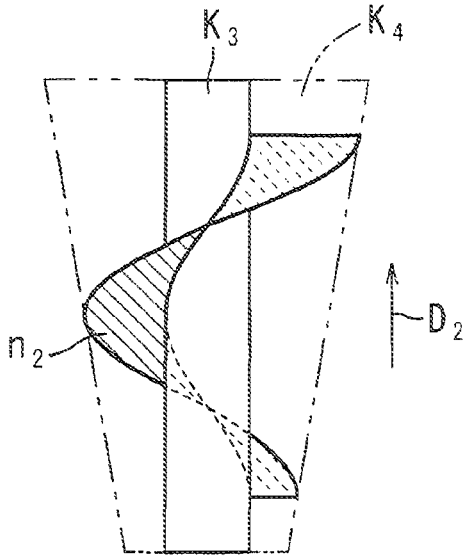
Figure 13C:
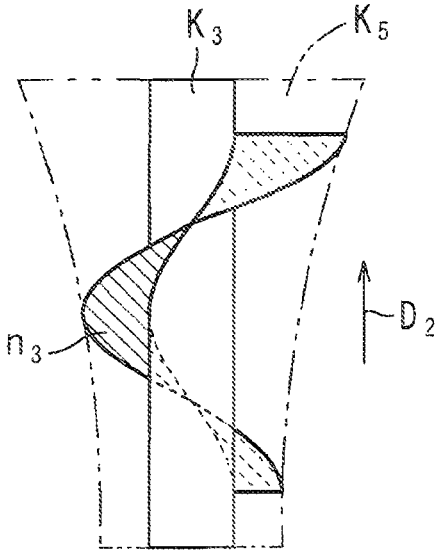
Figure 13D:
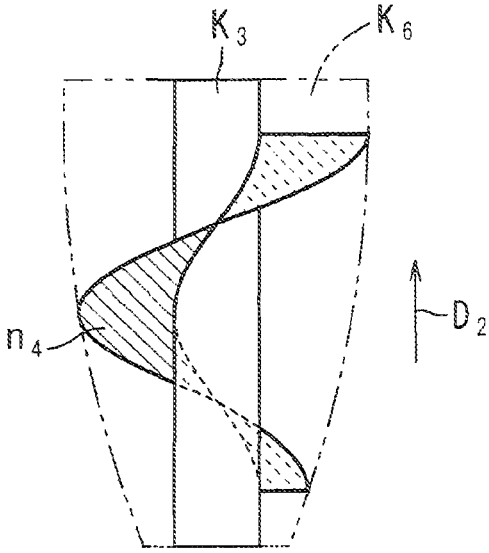

As shown in FIGS. 13B to 13D, an outer circumferential portion of the cone-shaped general spiral blade surface inscribes the side surface of an imaginary truncated cone having the same axial line as the imaginary circular column $K_3$. In this embodiment, the "truncated cone" as used herein is a solid having two bottom surfaces whose areas are different from each other, whose axial line runs through the two bottom surfaces, and whose external diameter continuously becomes larger as advancing in one direction of the axial line directions thereof. The shape of the imaginary truncated cone inscribed by the cone-shaped general spiral blade surface differs depending on the way that the length $m_2$ of the line segment $J_2$ changes. Further, in this embodiment, the outer circumferential portion of the cone-shaped general spiral blade surface is a portion which is the most distant from the axial line of the imaginary truncated cone on the general spiral blade surface.

FIG. 13B shows a cone-shaped general spiral blade surface $n_2$ inscribing an imaginary right circular truncated cone $K_4$. In this embodiment, the "right circular truncated cone" is a solid which is not a circular cone among two solids obtained by dividing a right circular cone on one plane parallel to the bottom surface. The trajectory of the line segment $J_2$ when the rate of change of the length $m_2$ of the line segment $J_2$ per unit moving distance along the general spiral $C_2$ is constant, corresponds to the cone-shaped general spiral blade surface $n_2$ depicted by the hatched portion in FIG. 13B, and the outer circumferential portion thereof inscribes the side surface of the imaginary right circular truncated cone $K_4$.

FIG. 13C shows a cone-shaped general spiral blade surface $n_3$ inscribing an imaginary compressed right circular truncated cone $K_5$. In this embodiment, the "compressed right circular truncated cone" is a solid having such a shape that the side surface of a right circular truncated cone is curved in a direction towards the axial line. The trajectory of the line segment $J_2$ when the rate of change of the length $m_2$ of the line segment $J_2$ per unit moving distance along the general spiral $C_2$ becomes gradually larger as advancing in one direction $D_2$, corresponds to the cone-shaped general spiral blade surface $n_3$ depicted by the hatched portion in FIG. 13C, and the outer circumferential portion thereof inscribes the side surface of the imaginary compressed right circular truncated cone $K_5$.

FIG. 13D shows a cone-shaped general spiral blade surface $n_4$ inscribing an imaginary expanded right circular truncated cone $K_6$. In this embodiment, the "expanded right circular truncated cone" is a solid having such a shape that the side surface of a right circular truncated cone is curved in a direction away from the axial line. The trajectory of the line segment $J_2$ when the rate of change of the length $m_2$ of the line segment $J_2$ per unit moving distance along the general spiral $C_2$ becomes gradually smaller as advancing in one direction $D_2$, corresponds to the cone-shaped general spiral blade surface $n_4$ depicted by the hatched portion in FIG. 13D, and the outer circumferential portion thereof inscribes the side surface of the imaginary expanded right circular truncated cone $K_6$.

The member with such a cone-shaped general spiral blade surface as the main surface is the cone-shaped general spiral blade. In a case where the cone-shaped general spiral blade is used as the outer spiral blade 202*b* as in this embodiment, the cone-shaped general spiral blade is disposed so that the cone-shaped general spiral blade surfaces $n_2$, $n_3$ and $n_4$ are located on the upstream side in the conveying direction X. The developer is conveyed to the upstream side in the conveying direction X by the cone-shaped general spiral blade surfaces $n_2$, $n_3$ and $n_4$. In this embodiment, the rotation direction $G_1$ is the right-handed direction when viewed in the conveying direction X. Therefore, in order to convey the developer on the upstream side in the conveying direction X by the cone-shaped general spiral blade surfaces $n_2$, $n_3$ and $n_4$, the cone-shaped general spiral blade needs to be implemented as a member having, as its main surface, a cone-shaped general spiral blade surface defined by a line segment which has been drawn along a right-handed general spiraling line, namely, a right-handed cone-shaped general spiral blade.

Further, in a case where the cone-shaped general spiral blade is used as the outer spiral blade 202*b*, an internal diameter $L_{24}$ of the outer spiral blade 202*b* (cone-shaped general spiral blade) becomes a value of two times the radius $r_2$ of the imaginary circular column $K_3$ as shown in FIG. 13A, and an external diameter $L_{25}$ thereof is continuously changed from maximum value of $2m_2+2r_2$ to minimum value of $2m_2+2r_2$ as it advances on the downstream side in the conveying direction X, as shown in FIGS. 13B to 13D. Here, the internal diameter $L_{24}$ of the outer spiral blade 202*b* (cone-shaped general spiral blade) is a value of two times a distance between an inner circumferential portion of the outer spiral blade 202*b* (cone-shaped general spiral blade) and an axial line of the imaginary circular column $K_3$, and the inner circumferential portion is a part on the outer spiral blade 202*b* (cone-shaped general spiral blade) in which the distance from the axial line of the imaginary circular column $K_3$ is the closest thereto in a cross section perpendicular to the axial line of the imaginary circular column $K_3$. Further, the external diameter $L_{25}$ of the outer spiral blade 202*b* (cone-shaped general spiral blade) is a value of two times a distance between an outer circumferential portion of the outer spiral blade 202*b* (cone-shaped general spiral blade) and the axial line of the imaginary circular column $K_3$, and the outer circumferential portion is a part on the outer spiral blade 202*b* (cone-shaped general spiral blade) in which the distance from the axial line of the imaginary circular column $K_3$ is the most distant therefrom in the cross section perpendicular to the axial line of the imaginary circular column $K_3$.

The internal diameter $L_{24}$ of the outer spiral blade 202*b* is settable as appropriate within a range of 18 mm or more and 29 mm or less, for example. The minimum value of the external diameter $L_{25}$ of the outer spiral blade 202*b* is settable as appropriate within a range of 20 mm or more and 32 mm or less, for example, and the maximum value thereof is settable as appropriate within a range of 21 mm or more and 40 mm or less, for example. Further, for example, the attachment angle β may not be 90°, and is settable as appropriate within a range of 30° or more and 150° or less. The lead angle $\theta_2$ is settable as appropriate within a range of 20° or more and 70° or less, for example. Further, a thickness $L_{26}$ of the outer spiral blade 202*b* is settable as appropriate within a range of 1 mm or more and 3 mm or less, and a length $L_{27}$ of the outer spiral blade 202*b* in the longitudinal direction thereof is about a quarter of the length of the rotation tube 202*d* in the axial direction thereof, and is settable as appropriate within a range of 50 mm or more and 100 mm or less, for example.

It is noted that, in this embodiment, the internal diameter $L_{24}$ of the outer spiral blade 202*b* is set to be equal to the sum of a value twice as large as the thickness $L_{21}$ of the rotation tube 202*d* and the external diameter $L_{17}$ of the inner spiral blade 202*a*.

The upstream spiral blade 202*c* rotates with the inner spiral blade 202*a*. With the rotation, the developer existing in the vicinity of the admission port portion 202*da* outside the rotation tube 202*d* is guided into the admission port portion 202*da*. The upstream spiral blade 202*c* has a shape which has a constant internal diameter and an external diameter which becomes small continuously as it advances on the upstream side in the conveying direction X. Expressed differently, the upstream spiral blade 202*c* has a shape which has a constant internal diameter and an external diameter which becomes large continuously as it advances on the downstream side in the conveying direction X.

In this embodiment, the upstream spiral blade 202*c* is a continuous left-handed cone-shaped general spiral blade, and is disposed so that the cone-shaped general spiral blade surfaces $n_2$, $n_3$ and $n_4$ are located on the downstream side in the conveying direction X. An internal diameter $L_{28}$ of the upstream spiral blade 202*c* is settable as appropriate within a range of 5 mm or more and 15 mm or less, for example, and the minimum value of an external diameter $L_{29}$ thereof is settable as appropriate within a range of 5 mm or more and 18 mm or less, for example, and the maximum value thereof is settable as appropriate within a range of 20 mm or more and 30 mm or less, for example. Further, for example, the attachment angle β described using FIG. 13A is settable as appropriate within a range of 30° or more and 150° or less. The lead angle $\theta_2$ is settable as appropriate within a range of 20° or more and 70° or less, for example. Further, a thickness $L_{30}$ of the upstream spiral blade 202*c* is settable as appropriate within a range of 1 mm or more and 3 mm or less, and a length $L_{31}$ of the upstream spiral blade 202*c* in the longitudinal direction thereof is settable as appropriate within a range of 30 mm or more and 50 mm or less.

It is noted that, in this embodiment, the internal diameter $L_{28}$ of the upstream spiral blade 202*c* is set to be equal to the internal diameter $L_{16}$ of the inner spiral blade 202*a*. The upstream spiral blade 202*c* and the inner spiral blade 202*a* merge smoothly with each other. Moreover, in this embodiment, the support member 202*f* located toward the second communication path S is fixed to the inner circumference of the upstream spiral blade 202*c*, and the internal diameter $L_{28}$ of the upstream spiral blade 202*c* is set to be equal to the external diameter of the support member 202*f*.

The delivery portion 202*e* rotates with the inner spiral blade 202*a* and the rotation tube 202*d*. With the rotation, the developer existing in the vicinity of the discharge port portion 202*db* outside the rotation tube 202*d* is delivered to the first communication path R.

In this embodiment, the delivery portion 202*e* is composed of four rectangular flat plates having the same shape. The four rectangular flat plates constituting the delivery portion 202*e* are each located between, of the four holes formed in the discharge port portion 202*db*, the corresponding two holes adjacent to each other in the circumferential direction of the rotation tube 202*d*. More specifically, the rectangular flat plates are disposed at regular intervals in the circumferential direction of the rotation tube 202*d*, and are each arranged in the neighborhood of the downstream end in the rotation direction $G_1$ of corresponding one of the two adjacent holes that is located upstream in the rotation direction $G_1$.

Each of the rectangular flat plates constituting the delivery portion 202*e* is, at its long side portion, fixed to the side surface of the rotation tube 202*d*. In this embodiment, each of the rectangular flat plates has its main surface extended along only radial and axial directions of the rotation tube 202*d*. A length of the long side portion of the rectangular flat plate is equal to or greater than the length $L_{22}$ in the conveying direction X of the rectangular hole formed in the discharge port portion 202*db*, whereas a length $L_{32}$ of the short side portion thereof is settable as appropriate within a range of 5 mm or more and 10 mm or less.

In contrast to the embodiment thus far described, as another embodiment, each of the rectangular flat plates constituting the delivery portion 202*e* may have its main surface extended along the radial direction, in the axial direction, and in the rotation direction $G_1$ of the rotation tube 202*d*. Moreover, as still another embodiment, the members constituting the delivery portion 202*e* may have different shapes. Further, the constituent member may be designed as a square flat plate instead of the rectangular flat plate. In addition, the number of the constituent members may be less than or equal to three, or greater than or equal to five regardless of the number of holes formed in the discharge port portion 202*db*.

According to the developing device 200 having the first developer conveying section 202 configured in this manner, the developer existing in the first conveying path P of the developer tank 201 flows, through the admission port portion 202*da* of the rotation tube 202*d*, into the rotation tube 202*d* on the upstream side in the conveying direction X. Then, the developer is conveyed downstream in the conveying direction X by the inner spiral blade 202*a* attached to the rotation tube 202*d* thereinside, and flows out of the rotation tube 202*d* through the discharge port portion 202*db* of the rotation tube 202*d*. At this time, the rotation tube 202*d* is in a state of rotating with the inner spiral blade 202*a*. With the rotation, friction is produced between the developer which is being conveyed by the inner spiral blade 202*a* and the inner peripheral wall of the rotation tube 202*d*, whereupon the developer is electrically charged.

Moreover, the developer which has flowed out through the discharge port portion 202*db* is delivered to the first communication path R by the delivery portion 202*e* having a length equal to or greater than the length in the conveying direction X of the hole formed in the discharge port portion 202*db*. This makes it possible to suppress that the developer is compressed when sandwiched between the inner spiral blade 202*a* and the delivery portion 202*e*, with the result that the developer can be conveyed smoothly while being kept in a fully charged state.

Hence, the developing device 200 pursuant to this embodiment is capable of conveying the developer in a fully charged state in the first conveying path P, and thus high-quality images can be produced by the image forming apparatus 100. Moreover, in the developing device 200, even fresh toner which has just been supplied into the developer tank 201 from the toner cartridge 300 can be fully charged swiftly by the first developer conveying section 202.

In a case where the developer stored in the developer tank 201 is a two-component developer composed of toner and carrier, when conveyed by the inner spiral blade 202*a*, the two-component developer is stirred by friction between itself and the inner peripheral wall of the rotation tube 202*d*. Thus, according to the developing device 200, toner and carrier can be mixed thoroughly. Moreover, in the developing device 200, even fresh toner which has just been supplied into the developer tank 201 from the toner cartridge 300 can be mixed thoroughly with carrier swiftly by the first developer conveying section 202.

In this embodiment, as the inner spiral blade 202*a* rotates in the rotation direction $G_1$, the delivery portion 202*e* is, in a position opposed to the first communication path R, moved in the vertical upwards direction to scoop the developer up and deliver it to the first communication path R. Accordingly, in the developing device 200, the developer which has flowed out through the discharge port portion 202*db* is directed swiftly to the first communication path R, wherefore the stress applied to the developer can be suppressed.

Moreover, in this embodiment, the developer tank 201 includes the first communication path bottom part 201*c* which is formed between the first conveying path-downstream region bottom part 201*g* and the second conveying path bottom part 201*b* so as to extend along the vertical upwards direction with increasing distance from the first conveying path-downstream region bottom part 201*g* and the second conveying path bottom part 201*b*. Accordingly, in the developing device 200, the developer is restrained from moving from the second conveying path Q to the first communication path R, and from there to the first conveying path P, with the consequent smooth conveyance of the developer.

Moreover, in this embodiment, the vertically upper surface 201*ca* of the first communication path bottom part 201*c* is situated vertically below the level of the axial line of the imaginary circular column surrounded by the inner spiral blade 202*a*. In this way, the developer sliding down the delivery portion 202*e* is allowed to move, through the first communication path R, to the second conveying path Q. Accordingly, the developing device 200 is capable of conveying the developer even more smoothly.

Moreover, in this embodiment, the first developer conveying section 202 includes the outer spiral blade 202*b*, and the supply port portion 205*a* for supplying a developer is disposed vertically above the outer spiral blade 202*b*. Therefore, fresh toner which has been supplied through the supply port portion 205*a* is firstly conveyed upstream in the conveying direction X by the outer spiral blade 202*b*, and whereafter flows into the rotation tube 202*d* through the admission port portion 202*da* of the rotation tube 202*d*. Then, the toner is conveyed downstream in the conveying direction X by the inner spiral blade 202*a*. Thus, according to the developing device 200, it is possible to lengthen the distance that fresh toner is conveyed without the necessity of upsizing of the developer tank 201, and thereby increase the chance of development of friction between the fresh toner and the inner wall of the developer tank 201, as well as the outer periphery of the rotation tube 202*d*. As a result, the fresh toner can be electrically charged even more reliably.

Moreover, in this embodiment, the outer spiral blade 202*b* is positioned so as to face the second communication path S. Therefore, the developer which has been conveyed through the second communication path S to the first conveying path P and fresh toner which has been supplied through the supply port portion 205*a* are each conveyed upstream in the conveying direction X, and whereafter flow into the rotation tube 202*d*. In this way, in the developing device 200, the existing developer stored in the developer tank 201 and the fresh toner supplied through the supply port portion 205*a* can be mixed thoroughly, wherefore insufficient developer charging can be suppressed. In the case where the developer stored in the developer tank 201 is a two-component developer composed of toner and carrier, according to the developing device 200, the existing two-component developer stored in the developer tank 201 and fresh toner supplied through the supply port portion 205*a* can be mixed thoroughly, wherefore unevenness of toner concentration in the two-component developer can be suppressed.

Moreover, in this embodiment, the developing device 200 includes the auxiliary tank 209. The internal space of the auxiliary tank 209 communicates with the upstream region in the conveying direction X of the first conveying path P. The rotation tube 202*d* of the first developer conveying section 202 extends into the auxiliary tank 209, whereon the admission port portion 202*da* of the rotation tube 202*d* is located inside the auxiliary tank 209. Therefore, the fresh toner supplied through the supply port portion 205*a* is conveyed into the auxiliary tank 209 by the outer spiral blade 202*b*, and then flows into the rotation tube 202*d* through the admission port portion 202*da*. Thus, according to the developing device 200, it is possible to lengthen the distance that fresh toner is conveyed even further, and thereby increase the chance of development of friction between the fresh toner and the inner wall of the auxiliary tank 209, as well as the outer periphery of the rotation tube 202*d*. As a result, the fresh toner can be electrically charged even more reliably. As another embodiment, the auxiliary tank 209 does not necessarily have to be provided.

Moreover, in this embodiment, the outer spiral blade 202*b* has a shape which has a constant internal diameter and an external diameter which becomes small continuously as it advances on the upstream side in the conveying direction X. The auxiliary tank 209 includes the first peripheral wall part 209*a* which is made to conform to the outer circumference of the outer spiral blade 202*b*, with a spacing of about 1 to 2 mm secured between the first peripheral wall part 209*a* and the outer circumference of the outer spiral blade 202*b*. Accordingly, the distance between the rotation tube 202*d* formed fixedly with the outer spiral blade 202*b* and the vertically lower part of the first peripheral wall part 209*a* becomes narrower gradually as it advances on the upstream side in the conveying direction X. Therefore, of the fresh toner supplied through the supply port portion 205*a*, the developer contacted by the vertically lower part of the first peripheral wall part 209*a* is conveyed upstream in the conveying direction X by the outer spiral blade 202*b* while being pushed vertically upwardly along the first peripheral wall part 209*a* by the rotation tube 202*d*. As a result, friction is produced between the developer which is being conveyed by the outer spiral blade 202*b* and the first peripheral wall part 209*a*, whereupon the developer is electrically charged. In this way, according to the developing device 200, fresh toner which has been supplied through the supply port portion 205*a* can be electrically charged even more reliably. As another embodiment, the outer spiral blade 202*b* may be the general spiral blade.

Moreover, in this embodiment, the first developer conveying section 202 includes the upstream spiral blade 202*c* which is continuous with the upstream side in the conveying direction X of the inner spiral blade 202*a* and, has a shape which has a constant internal diameter and an external diameter which becomes small continuously as it advances on the upstream side in the conveying direction X (expressed differently, the external diameter thereof increases continuously as it advances on the downstream side in the conveying direction X). The auxiliary tank 209 includes the second peripheral wall part 209*b* which is made to conform to the outer circumference of the upstream spiral blade 202*c*, with a spacing of about 1 to 2 mm secured between the second peripheral wall part 209*b* and the outer circumference of the upstream spiral blade 202*c*. Accordingly, the amount of developer to be conveyed downstream in the conveying direction X by the upstream spiral blade 202*c* increases gradually as it advances on the downstream side in the conveying direction X. This makes it possible to reduce the rate of developer conveyance effected by the upstream spiral blade 202*c* as a whole while keeping the amount of developer to be conveyed in the vicinity of the admission port portion 202*da* of the rotation tube 202*d* at a high level. As a result, the developer can be guided adequately into the rotation tube 202*d* more reliably.

In order to increase the amount of developer to be conveyed in the vicinity of the admission port portion 202*da* while controlling the overall rate of developer conveyance, as has already been described, it is preferable that the upstream spiral blade 202*c* is designed as the cone-shaped general spiral blade having the cone-shaped general spiral blade surface $n_3$ which is inscribed in the imaginary compressed right circular truncated cone $K_5$ as shown in FIG. 13C. As another embodiment, the upstream spiral blade 202*c* does not necessarily have to be provided.

Moreover, in this embodiment, the first developer conveying section 202 has the support members 202*f* at its upstream and downstream ends in the conveying direction X. In this way, it is possible to drive the first developer conveying section 202 via the support members 202*f*, with the consequent simplification of the driving mechanism of the developing device 200. As another embodiment, the first developer conveying section 202 may be so designed that it can be supported without involvement of the support members 202*f*.

Moreover, in this embodiment, the developer tank 201 includes the downstream barrier part 201*h* which is adjacent to the first conveying path-downstream region bottom part 201*g* at a location upstream from the first conveying path-downstream region bottom part 201*g* in the conveying direction X, and extends along the vertical upwards direction so as to be situated vertically above the level of the first conveying path-downstream region bottom part 201*g*. Thereby, in the developing device 200, it is possible to suppress entry of the developer into the space between the first developer conveying section 202 and the inner wall of the developer tank 201 from the downstream side in the conveying direction X. As another embodiment, the downstream barrier part 201*h* does not necessarily have to be provided.

Moreover, in this embodiment, the developer tank 201 includes the upstream barrier part 201*f* which is adjacent to the first conveying path-upstream region bottom part 201*e* at a location downstream from the first conveying path-upstream region bottom part 201*e* in the conveying direction X, and extends along the vertical upwards direction so as to be situated vertically above the level of the first conveying path-upstream region bottom part 201*e*. Thereby, in the developing device 200, it is possible to suppress entry of the developer into the space between the first developer conveying section 202 and the inner wall of the developer tank 201 from the upstream side in the conveying direction X. As another embodiment, the upstream barrier part 201*f* does not necessarily have to be provided.

Moreover, in this embodiment, the internal space at a longitudinal central portion of the inner spiral blade 202*a* is not provided with any structural component, and this internal space is utilized as a space for developer movement. That is, the developer existing in the internal space of the inner spiral blade 202*a*, not being forced by the inner spiral blade 202*a*, tends not to move downstream in the conveying direction X but to stay there. As a result, the developer staying in the internal space of the inner spiral blade 202*a* seems to move upstream in the conveying direction X with respect to the developer which is moving downstream in the conveying direction X. Therefore, in this embodiment, developer components tend to move relatively in two directions within the rotation tube 202*d*, with the consequent repulsion of developer components. This phenomenon facilitates the movement of a part of the developer in a direction other than the conveying direction X, for example, the vertical direction. It is thus possible to increase the chance of development of friction between the developer and the inner spiral blade 202*a* as well as the rotation tube 202*d*, and thereby charge the developer more reliably. Moreover, since the internal space of the inner spiral blade 202*a* is not provided with any structural component, it is possible to store as much as possible of developer in the developer tank 201. As another embodiment, a columnar member may be disposed in the internal space at the longitudinal central portion of the inner spiral blade 202*a*.

Moreover, in this embodiment, the vertically upper surface 201*ca* of the first communication path bottom part 201*c* is made with an inclination, with a side of the first conveying path P situated vertically above the level of the side of the second conveying path Q. Accordingly, in the developing device 200, the developer is restrained from moving from the second conveying path Q to the first communication path R, and from there to the first conveying path P more reliably, with the consequent smooth conveyance of the developer.

Moreover, in this embodiment, the vertically upper surface 201*da* of the second communication path bottom part 201*d* is made with an inclination, with the side of the second conveying path Q situated vertically above the level of the side of the first conveying path P. Accordingly, the developer existing on the vertically upper surface 201*da* of the second communication path bottom part 201*d* tends to move toward the first conveying path P under its own weight. Thereby, in the developing device 200, retention of developer in the second communication path S can be suppressed.

Moreover, in this embodiment, the vertically upper surface 201*ea* of the first conveying path-upstream region bottom part 201*e* is made with an inclination, with its upstream side in the conveying direction X situated vertically above the level of its downstream side in the conveying direction X. The vertically upper surface 209*ca* of the auxiliary tank bottom part 209*c* is continuous with the upstream side in the conveying direction X of the vertically upper surface 201*ea* of the first conveying path-upstream region bottom part 201*e*, and is made with an inclination, with its upstream side in the conveying direction X situated vertically above the level of its downstream side in the conveying direction. Accordingly, the developer existing on the vertically upper surface 209*ca* of the auxiliary tank bottom part 209*c* tends to move downstream in the conveying direction X under its own weight. Thereby, in the developing device 200, the developer within the auxiliary tank 209 is allowed to flow into the rotation tube 202*d* more reliably.

Moreover, in this embodiment, the columnar rotation tube 202*d* has the outlet opening portion 202*dc* formed at the bottom surface of its downstream side in the conveying direction X. Thereby, even if the developer which is being conveyed by the inner spiral blade 202*a* fails to flow out of the discharge port portion 202*db*, the developer can be conveyed to the outside of the rotation tube 202*d* through the outlet opening portion 202*dc*. This makes it possible to avoid developer compression inside the rotation tube 202*d*.

Moreover, in this embodiment, the rectangular flat plates constituting the delivery portion 202*e* are disposed at regular intervals in the circumferential direction of the rotation tube 202*d*, and are each arranged in the neighborhood of the downstream end in the rotation direction $G_1$ of corresponding one of the two adjacent holes formed in the discharge port portion 202*db* that is located upstream in the rotation direction $G_1$. The first developer conveying section 202 is thus capable of scooping the developer up more reliably by the side surface of the rotation tube 202*d* and the main surface of the rectangular flat plate sandwiched between the two adjacent holes. This makes it possible to suppress retention of developer on the downstream side in the conveying direction X of the first conveying path P.

The technology may be embodied in other specific forms without departing from the spirit or essential characteristics thereof. The present embodiments are therefore to be considered in all respects as illustrative and not restrictive, the scope of the technology being indicated by the appended claims rather than by the foregoing description and all changes which come within the meaning and the range of equivalency of the claims are therefore intended to be embraced therein.

What is claimed is:

1. A developing device for developing an electrostatic latent image formed on an image bearing member by supplying a stored developer to the image bearing member, including:

a developer tank that stores a developer;

a partition wall that divides an internal space of the developer tank into:

a first conveying path extending along a longitudinal direction of the partition wall, a second conveying path extending along the first conveying path so that the partition wall is between the first conveying path and the second conveying path, and being closer to the image bearing member, a first communication path for providing communication between the first conveying path and the second conveying path at a side of one end of the partition wall in the longitudinal direction, and a second communication path for providing communication between the first conveying path and the second conveying path at a side of the other end of the partition wall in the longitudinal direction;

a first developer conveying section that is disposed in the first conveying path and conveys a developer in the developer tank from the side of the other end to the side of the one end of the partition wall of the longitudinal direction, the first developer conveying section including:

an inner spiral blade having a shape that is spirally wound on a side surface of an imaginary circular column, the inner spiral blade being rotated around an axial line of the imaginary circular column for conveying a developer from the side of the other end to the side of the one end of the partition wall in the longitudinal direction, a rotation tube configured to surround an outer circumference of the inner spiral blade and rotate with the inner spiral blade, and comprising an admission port portion in which a hole for admitting a developer into the rotation tube is formed and a discharge port portion in which a hole for discharging a developer from the inside of the rotation tube is formed, the admission port portion being at the side of the other end of the partition wall in the longitudinal direction and the discharge port portion being at the side of the one end of the partition wall in the longitudinal direction, and a delivery portion fixed to a part of an outer periphery of the rotation tube, the part being at the side of the one end of the partition wall in the longitudinal direction, the delivery portion rotating with the rotation tube to deliver a developer existing outside the rotation tube to the first communication path, the discharge port portion being disposed between one end and the other end of the delivery portion in the longitudinal direction; and a second developer conveying section that is disposed in the second conveying path, and conveys a developer from the side of the one end to the side of the other end of the partition wall in the longitudinal direction.

2. The developing device of claim 1, wherein a direction of rotation of the inner spiral blade is determined so that a part of the delivery portion located toward the first communication path moves vertically upward while the inner spiral blade rotates.

3. The developing device of claim 1, wherein the developer tank includes a first communication path bottom part opposed to the first communication path, the first communication path bottom part being configured so as to extend along a vertical upwards direction with increasing distance from the first conveying path and the second conveying path.

4. The developing device of claim 3, wherein a vertically upper part of the first communication path bottom part is situated vertically below a level of the axial line of the imaginary circular column.

5. An electrophotographic image forming apparatus comprising the developing device of claim 1.

* * * * *